US012595605B2

(12) United States Patent
Matsuoka et al.

(10) Patent No.: US 12,595,605 B2
(45) Date of Patent: Apr. 7, 2026

(54) SEWING MACHINE FRAME

(71) Applicant: BROTHER KOGYO KABUSHIKI KAISHA, Nagoya (JP)

(72) Inventors: Yusuke Matsuoka, Nagoya (JP); Kenichi Mizuno, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 18/973,595

(22) Filed: Dec. 9, 2024

(65) Prior Publication Data

US 2025/0223740 A1 Jul. 10, 2025

(30) Foreign Application Priority Data

Jan. 10, 2024 (JP) ..... 2024-001979

(51) Int. Cl.
*D05B 73/02* (2006.01)
*D05B 73/08* (2006.01)

(52) U.S. Cl.
CPC ..... *D05B 73/02* (2013.01); *D05B 73/08* (2013.01)

(58) Field of Classification Search
CPC ..... D05B 75/00; D05B 73/02; D05B 73/08; D05B 73/00; D05B 73/005; D05B 73/04; D05B 73/06
USPC ..... 112/258, 259, 260
See application file for complete search history.

(56) References Cited

U.S. PATENT DOCUMENTS 2,411,459 A * 11/1946 Perkins ..... D05B 73/00 112/258
3,467,041 A * 9/1969 Greulich ..... D05B 27/02 112/323
3,866,553 A * 2/1975 Adams ..... D05B 73/00 112/258
4,059,062 A * 11/1977 Drevet ..... D05B 77/00 112/258
4,079,684 A * 3/1978 Thomson ..... D05B 57/02 112/169
4,193,361 A * 3/1980 Johnson ..... D05B 73/00 112/259

(Continued)

FOREIGN PATENT DOCUMENTS

JP S57-064089 A 4/1982
JP 2008-245733 A 10/2008

(Continued)

*Primary Examiner* — Danny Worrell
(74) *Attorney, Agent, or Firm* — OLIFF PLC.

(57) ABSTRACT

A sewing machine frame includes a pillar frame and an extending frame. The extending frame extends from one end in a longitudinal direction of the pillar frame, in an extending direction orthogonal to the longitudinal direction. The extending frame includes a first extending plate, a second extending plate, and an extending intermediate plate. The first extending plate extends in the extending direction. The second extending plate is separated from the first extending plate in the longitudinal direction. The second extending plate faces the first extending plate and extends in the extending direction. The extending intermediate plate extends in the longitudinal direction and the extending direction. The extending intermediate plate couples the first extending plate and the second extending plate in the longitudinal direction, and the extending intermediate plate has a curved surface.

19 Claims, 12 Drawing Sheets

(56) References Cited

U.S. PATENT DOCUMENTS 4,429,650 A * 2/1984 Ishikawa ..... D05B 73/00 112/258
4,552,081 A * 11/1985 Vartoukian ..... D05B 73/00 112/195
4,628,845 A * 12/1986 Matsuda ..... D05B 73/00 112/259
4,875,422 A * 10/1989 Ishikawa ..... D05B 73/00 112/245
5,140,918 A * 8/1992 Combepine ..... D05B 73/00 112/258
5,231,942 A * 8/1993 Beau ..... D05B 73/00 112/258
6,694,902 B2 * 2/2004 Sakakibara ..... D05B 75/00 112/258
6,796,255 B2 * 9/2004 Ogi ..... D05B 73/06 112/258
6,814,017 B2 * 11/2004 Sakakibara ..... D05B 73/00 112/258
7,040,243 B1 * 5/2006 Chang ..... D05B 73/00 112/258
2003/0066466 A1 * 4/2003 Ogi ..... D05B 73/00 112/258
2003/0066467 A1 * 4/2003 Sakakibara ..... D05B 73/00 112/258
2003/0154893 A1 * 8/2003 Sakakibara ..... D05B 75/00 112/258
2005/0178308 A1 * 8/2005 Chang ..... D05B 73/00 112/258
2005/0204977 A1 * 9/2005 Chang ..... D05B 73/00 112/258
2020/0010991 A1 1/2020 Minematsu et al.

FOREIGN PATENT DOCUMENTS

JP 2010167111 A * 8/2010
JP 2020-005694 A 1/2020

* cited by examiner

SEWING MACHINE FRAME

REFERENCE TO RELATED APPLICATIONS

This application claims priority from Japanese Patent Application No. 2024-001979 filed on Jan. 10, 2024. The entire content of the priority application is incorporated herein by reference.

BACKGROUND ART

The present disclosure relates to a sewing machine frame.

In a known sewing machine frame, a horizontal cross-section of a pillar configuring the sewing machine frame has an S shape along a longitudinal direction of an arm and a bed. The sewing machine frame includes an X-shaped rib that reinforces the rigidity of the pillar, inside one of frames positioned at a tip end side of the arm. The pillar and the rib are formed of resin, which is lighter than cast iron and die-cast aluminum, and weight reduction is achieved compared to a known sewing machine.

SUMMARY

In the known sewing machine frame, it is not possible to ignore the impact of a load acting on the arm due to driving of a needle bar disposed at a position separated from the pillar. When, in order to secure the rigidity of the sewing machine frame, the thickness of the sewing machine frame is made thicker, or a number of the ribs is increased, the lightweightness of the sewing machine frame is impaired. Thus, it is difficult to achieve both the rigidity and the lightweightness of the sewing machine frame.

Embodiments of the broad principles derived herein provide a sewing machine frame that contributed to achieving both rigidity and lightweightness, compared to known art.

Embodiments provide a sewing machine frame according to a first aspect that includes a pillar frame and an extending frame. The extending frame extends from one end in a longitudinal direction of the pillar frame, in an extending direction orthogonal to the longitudinal direction. The extending frame includes a first extending plate, a second extending plate, and an extending intermediate plate. The first extending plate extends in the extending direction. The second extending plate is separated from the first extending plate in the longitudinal direction. The second extending plate faces the first extending plate and extends in the extending direction. The extending intermediate plate extends in the longitudinal direction and the extending direction. The extending intermediate plate couples the first extending plate and the second extending plate in the longitudinal direction, and the extending intermediate plate has a curved surface. In the sewing machine frame that is susceptible to a load acting thereon due to driving of a sewing machine, compared to a case in which the extending intermediate plate only has flat surfaces, the extending intermediate plate of the sewing machine frame contributes to increasing the rigidity of the extending frame without causing an increase in weight. In other words, the extending intermediate plate of the sewing machine frame contributes to achieving both rigidity and lightweightness, compared to known art.

Embodiments provide a sewing machine frame according to a second aspect that includes a pillar frame and an arm frame. The arm frame extends from the pillar frame in an extending direction orthogonal to a longitudinal direction of the pillar frame. The arm frame includes a first extending plate, a second extending plate, and an extending intermediate plate. The first extending plate extends in the extending direction. The second extending plate is separated from the first extending plate in the longitudinal direction. The second extending plate faces the first extending plate and extends in the extending direction. The extending intermediate plate extending in the extending direction, the extending intermediate plate coupling the first extends plate and the second extending plate. The extending intermediate plate has a curved surface. The curved surface has a cross-sectional shape as a curved line in a plane perpendicular to the direction. The sewing machine frame according to the second aspect has the same effect as the sewing machine frame according to the first aspect.

DESCRIPTION

Figure 1:
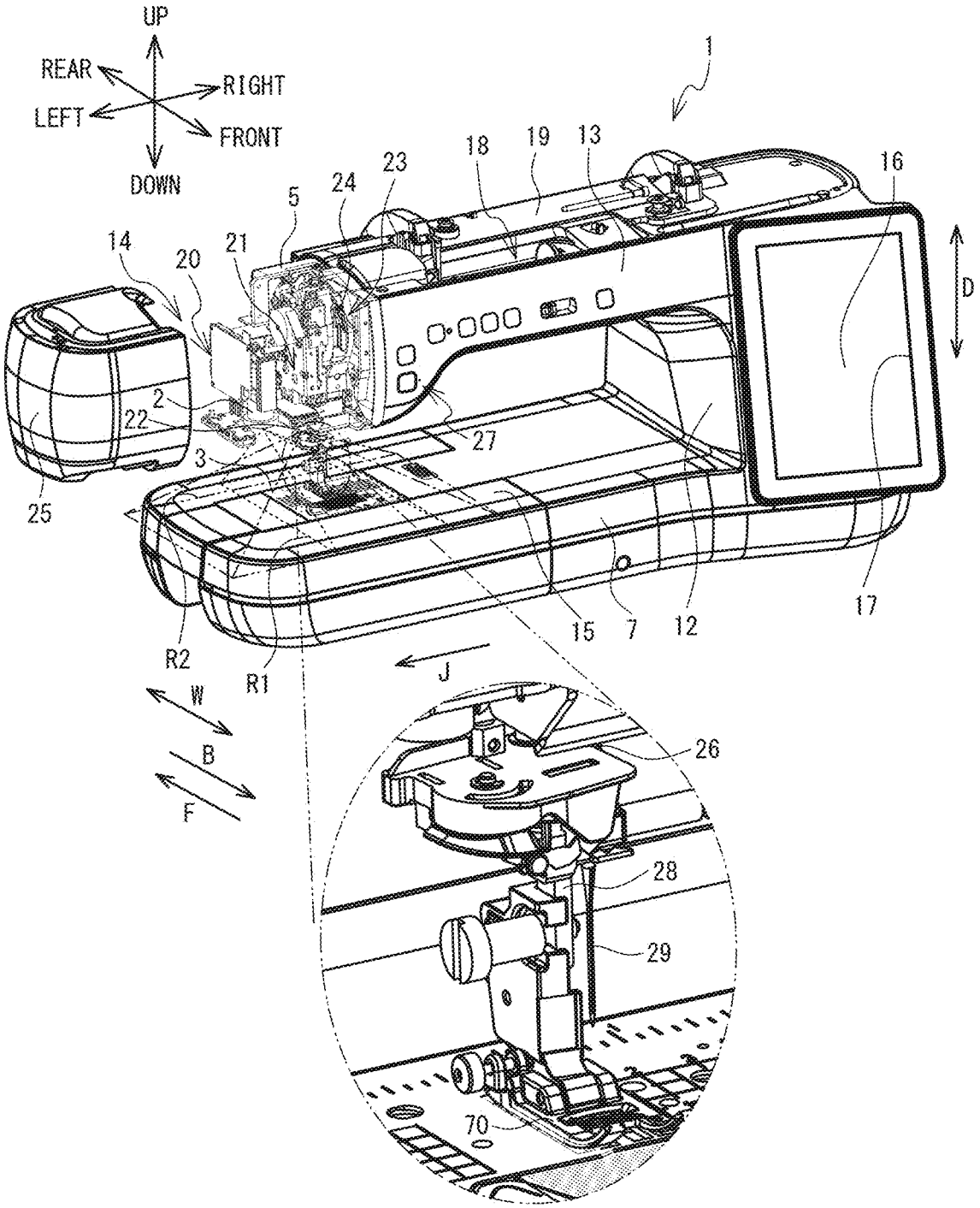
FIG. 1 is a perspective view of a sewing machine in a state in which a cover is removed.
Figure 2:
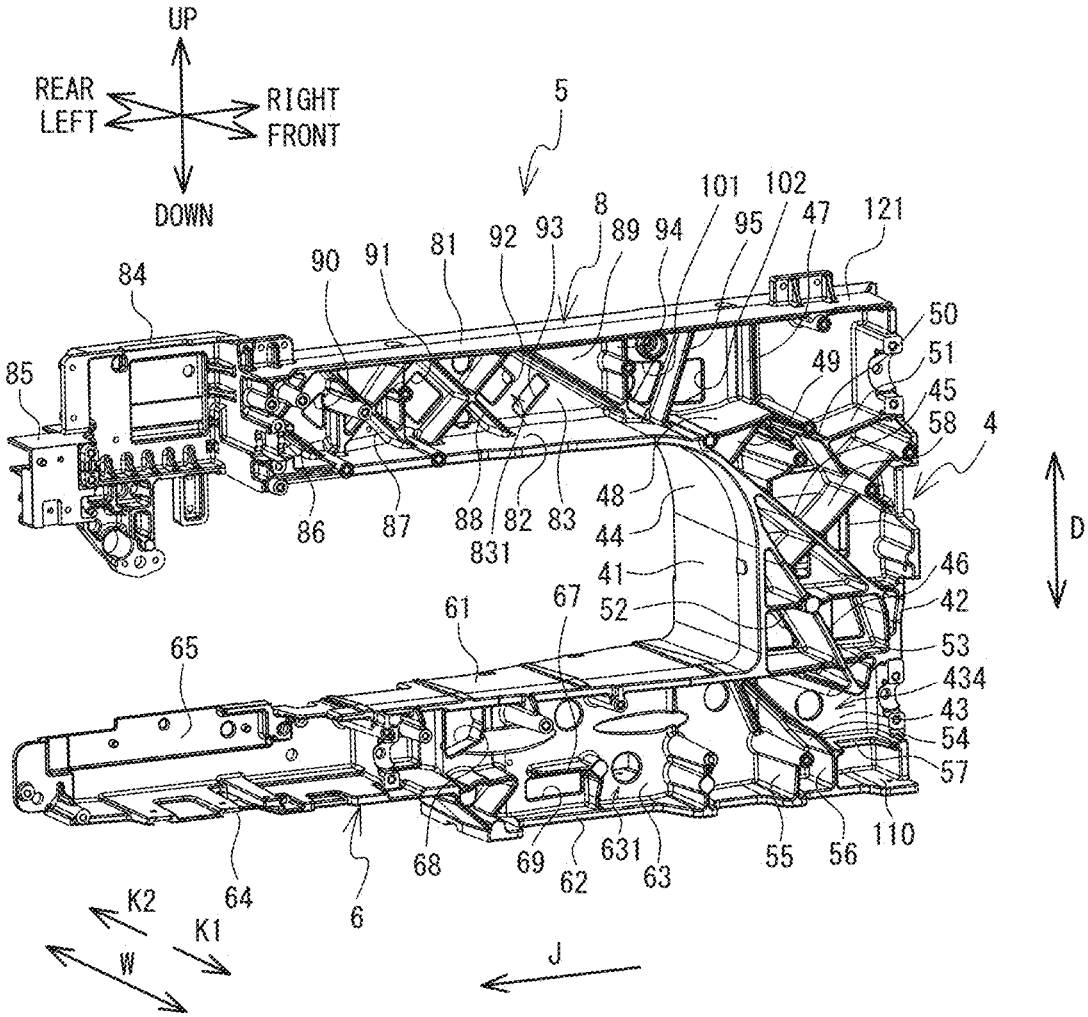
FIG. 2 is a perspective view of a sewing machine frame.

A sewing machine 1 that includes a sewing machine frame 5 according to an embodiment of the present disclosure will be described with reference to the drawings. The up-down direction, the lower left direction, the upper right direction, the upper left direction, and the lower right direction in FIG. 1 are, respectively, the up-down direction, the left direction, the right direction, the rear direction, and the front direction of the sewing machine 1. The up-down direction, the lower left direction, the upper right direction, the upper left direction, and the lower right direction in FIG. 2 are, respectively, the up-down direction, the left direction, the right direction, the rear direction, and the front direction of the sewing machine frame 5. A longitudinal direction D of a pillar 12 and a pillar frame 4 is the up-down direction of the sewing machine 1 and the sewing machine frame 5. The left direction is defined as an extending direction J. The front-rear direction that is orthogonal to each of the longitudinal direction D and the extending direction J is defined as an orthogonal direction W. A direction from a needle bar 26 toward a presser bar 28 is the rear direction and is defined as a forward feed direction F and a second direction K2. A direction opposite the forward feed direction F is the front direction and is defined as a reverse feed direction B and a first direction K1.

As shown in FIG. 1 and FIG. 2, the sewing machine 1 includes the sewing machine frame 5, a bed 7, the pillar 12, and an arm 13. The sewing machine frame 5 is formed of metal having a comparatively high rigidity, such as an aluminum alloy or the like, and supports the structural components of the sewing machine 1. The sewing machine frame 5 has a U shape that is open to the left in a front view.

The sewing machine frame 5 includes the pillar frame 4, a bed frame 6, and an arm frame 8. The arm frame 8 extends in the extending direction J orthogonal to the longitudinal direction D, from one end, in the longitudinal direction D, of the pillar frame 4. The bed frame 6 extends in the extending direction J orthogonal to the longitudinal direction D, from the other end, in the longitudinal direction D, of the pillar frame 4. The configuration of the sewing machine frame 5 will be described in detail later.

The pillar 12 extends in the up-down direction. In the interior of the pillar 12, the sewing machine 1 includes the pillar frame 4, a sewing machine motor, a transmission member, and a power source. The pillar frame 4 supports the sewing machine motor and the transmission member. The sewing machine motor is configured to rotate a drive shaft, to be described later, using power supplied from the power source. The transmission member transmits the power of the sewing machine motor to a lower shaft to be described later. In the sewing machine 1, a vertically long liquid crystal display (LCD) 17 and a touch screen 16 are arranged on the front surface of the pillar 12. The LCD 17 is configured to display messages and the like necessary for sewing operations. The touch screen 16 is arranged on the front surface of the LCD 17. When a user operates the touch screen 16 using an indicator, such as a finger or a special pen, in order to select an item displayed on the LCD 17, the operating position on the touch screen 16 is detected. The user can input various instructions to the sewing machine 1 via the touch screen 16.

The bed 7 extends in the extending direction J orthogonal to the up-down direction from a lower end of the pillar 12. An upper surface 15 of the bed 7 extends in a horizontal direction and includes a needle plate 3. A needle hole through which a sewing needle 29 passes is arranged in the needle plate 3. The sewing machine 1 includes the bed frame 6, the lower shaft, a feed mechanism and a shuttle mechanism and the like, below the needle plate 3 of the bed 7. The bed frame 6 supports the lower shaft, the feed mechanism, and the shuttle mechanism. The lower shaft extends in the left-right direction. The feed mechanism includes a feed dog. The feed mechanism is configured to drive the feed dog in accordance with the rotation of the lower shaft, to move a sewing object in the forward feed direction F or the reverse feed direction B by a predetermined movement amount. The forward feed direction F corresponds to the direction in which the sewing machine 1 is arranged with respect to the user. The shuttle mechanism includes a shuttle. The shuttle mechanism is configured to drive the shuttle in accordance with the rotation of the lower shaft, to hook an upper thread around a lower thread.

The arm 13 extends in the extending direction J parallel to the bed 7, from an upper end of the pillar 12, above the bed 7. Inside the arm 13, the sewing machine 1 includes the arm frame 8, the drive shaft, and the like. The arm 13 has a head 14 on a left end thereof. The head 14 includes a needle bar mechanism 21, a thread take-up lever mechanism 23, an image sensor 22, and a projector module 20. The arm frame 8 supports the needle bar mechanism 21, the thread take-up lever mechanism 23, the image sensor 22, and the projector module 20. A detachable cover 25 is further arranged on the head 14. The needle bar mechanism 21, the thread take-up lever mechanism 23, the projector module 20, and the image sensor 22 are supported by a metal frame fixed to the front of the sewing machine frame 5 and are covered by the cover 25 in a case where the cover 25 is mounted to the head 14.

The needle bar mechanism 21 has the needle bar 26 extending in the up-down direction and is configured to move the needle bar 26 back and forth in the up-down direction. The lower end portion of the needle bar 26 protrudes downward from the lower end of the head 14. The sewing needle 29 is detachably attached to the lower end of the needle bar 26. The sewing needle 29 that has been attached to the needle bar 26 moves back and forth in the up-down direction. The presser bar 28 extends in the up-down direction behind the needle bar 26 and is configured to move back and forth in the up-down direction synchronously with the driving of the needle bar 26. A presser foot 70 is detachably attached to the lower end portion of the presser bar 28. The upper thread inserted through the sewing needle 29 is hooked around the lower thread by the shuttle to form a stitch on the sewing object. The thread take-up lever mechanism 23 has a thread take-up lever 24 with a hole through which the upper thread passes. The thread take-up lever 24 arranged in the reverse feed direction B, i.e., forward, with respect to the needle bar 26. The thread take-up lever mechanism 23 is configured to move the thread take-up lever 24 back and forth in the up-down direction. Therefore, the thread take-up lever 24 pulls the upper thread up and adjusts the position of the knot with the lower thread.

The image sensor 22 is configured to capture an image of an imaging area R2 on the bed 7. One example of an imaging target of the image sensor 22 is a projection image projected onto the sewing object. The imaging area R2 includes at least a portion of a projection area R1 of a projector 2 which will be described later. The projector module 20 is arranged separated from the needle bar 26 in the extending direction J. The projector module 20 includes the projector 2. The projector 2 is arranged at the tip end of the arm 13 in the extending direction J and is configured to project the projection image in the projection area R1 on the bed 7.

In the sewing machine 1, a plurality of switches including a start/stop switch 27 are arranged on the front surface of the arm 13. The start/stop switch 27 is a switch for instructing the start and stop of a sewing operation. In the sewing machine 1, a sewing machine cover that can be opened and closed, is arranged on a top portion of the arm 13. In FIG. 1, the sewing machine cover of the arm 13 is omitted. The sewing machine 1 includes a thread accommodating portion 18 on an upper surface 19 of the arm 13, which is exposed in a case where the sewing machine cover is open. The thread accommodating portion 18 is a recess recessed downward that is configured to accommodate a thread spool around which the upper thread is wound.

Operations of the sewing machine 1 having the above-described configuration at a time of sewing will be briefly described. In a case where the sewing machine 1 detects depression of the start/stop switch 27, the sewing machine 1 synchronously drives the shuttle mechanism, the feed mechanism, the needle bar mechanism 21, and the thread take-up lever mechanism 23. Therefore, a stitch is formed in the sewing object placed on the upper surface 15 of the bed 7 by the sewing needle 29 mounted to the needle bar 26.

The sewing machine frame 5 will be described in detail with reference to FIG. 2 to FIG. 12. The longitudinal direction D of the pillar frame 4 defines the up-down direction. The extending direction J orthogonal to the longitudinal direction D defines the left direction. The orthogonal direction W orthogonal to both the longitudinal direction D and the extending direction J defines the front-rear direction. The orthogonal direction W extends in both directions and includes the first direction K1 and the second direction K2 opposite to the first direction K1. In the orthogonal direction W of the present embodiment, which is the front-rear direction, the first direction K1 is the front direction, and the second direction K2 is the rear direction. A thickness of a rib disposed in the sewing machine frame 5 is defined as a length thereof in a width direction orthogonal to both a protruding direction of the rib and a longitudinal direction of the rib.

Figure 4:
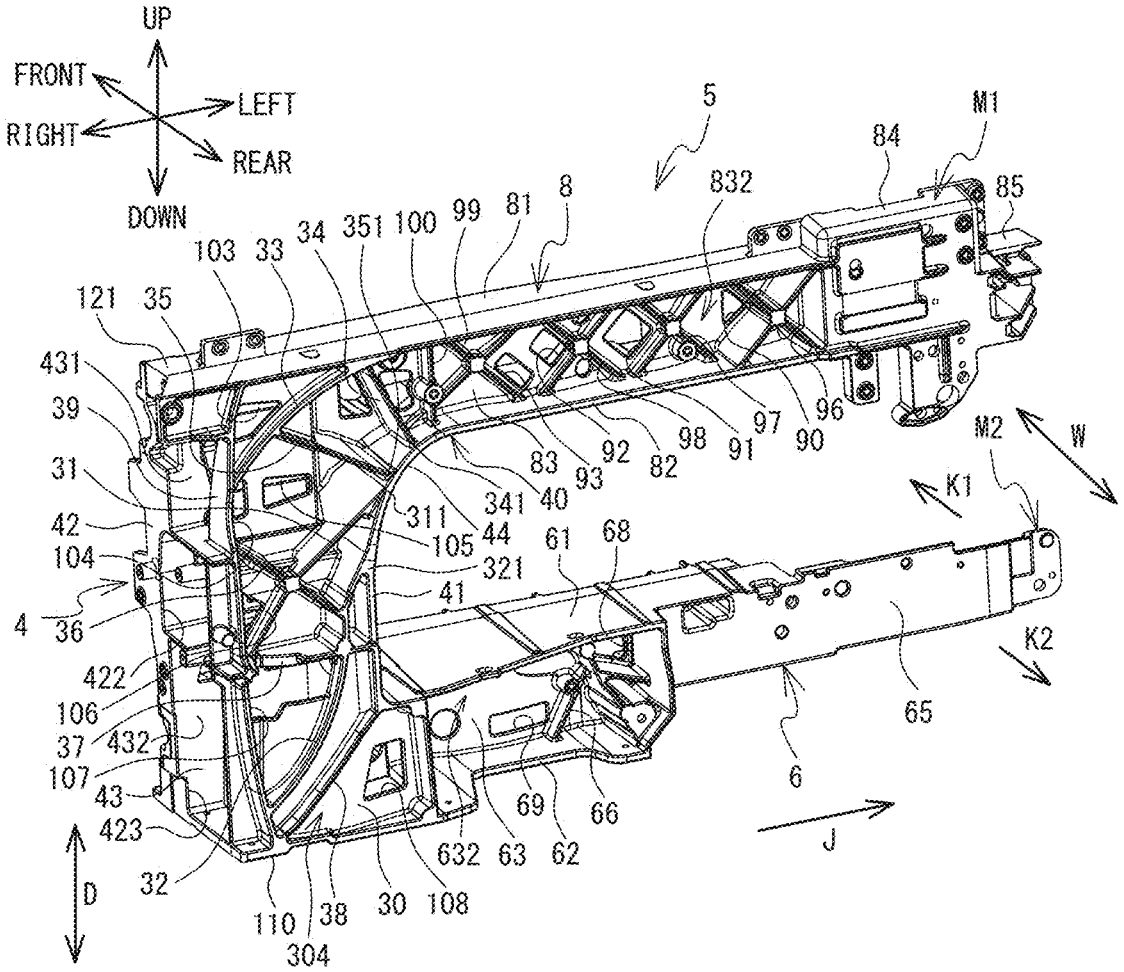
FIG. 4 is a perspective view of the sewing machine frame.
Figure 5:
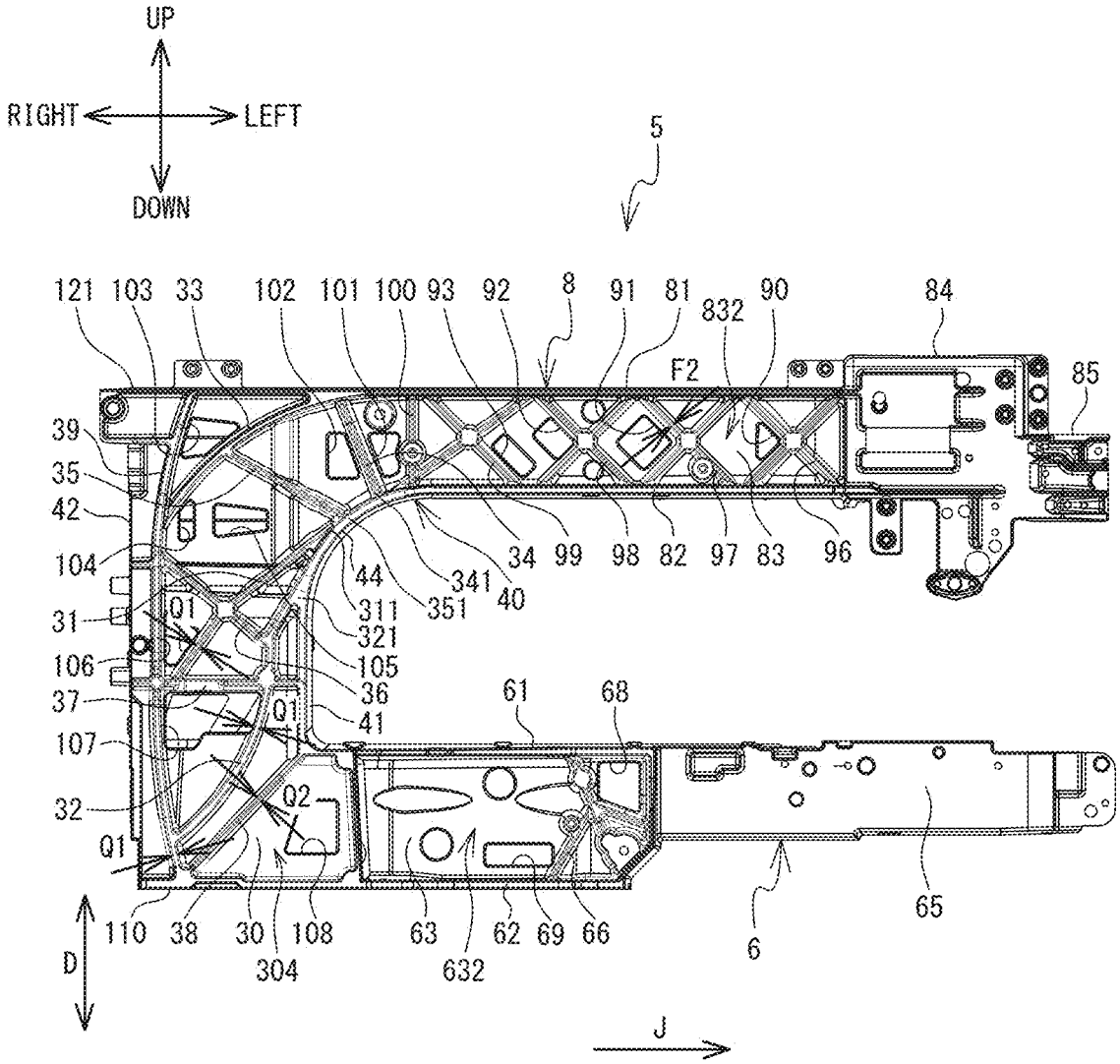
FIG. 5 is a back view of the sewing machine frame.
Figure 6:
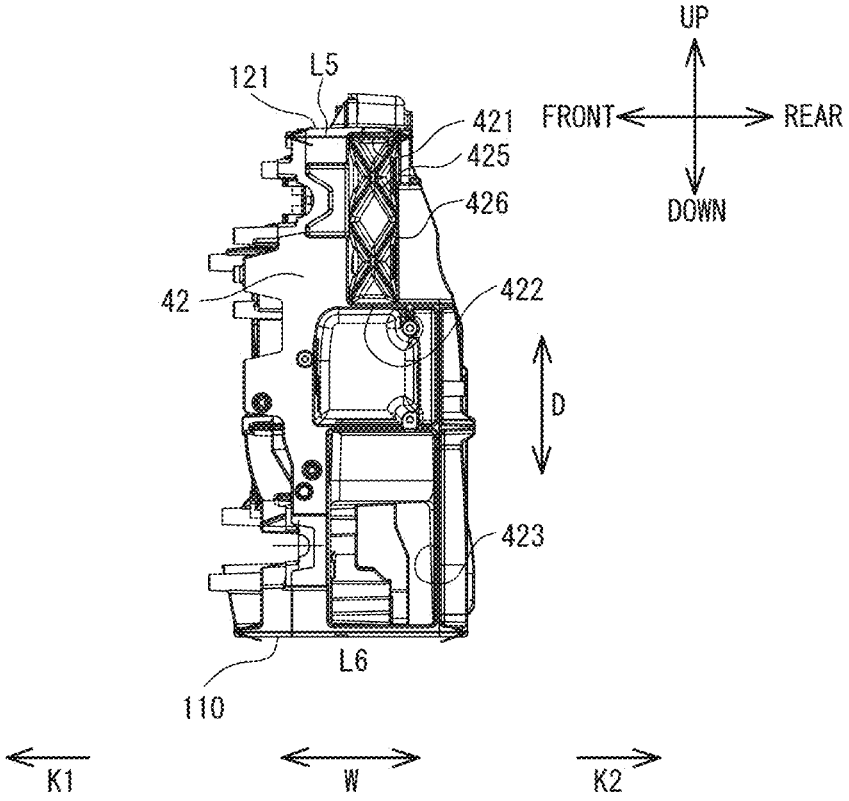
FIG. 6 is a right side view of the sewing machine frame.

As shown in FIG. 2 to FIG. 7, the pillar frame 4 includes a first pillar plate 41, a coupling curved plate 44, a second pillar plate 42, a pillar upper plate 121, a pillar lower plate 110, pillar plates 30 and 43, first pillar ribs 45, 46, 31, 32, and 39, and second pillar ribs 47 to 58 and 33 to 38. The first pillar plate 41 and the second pillar plate 42 extend in the longitudinal direction D. The first pillar plate 41 configures the left surface of the pillar frame 4. The coupling curved plate 44 is disposed below a coupling section 40 between the arm frame 8 and the pillar frame 4 and is a plate that is curved in an arc shape in a front view. The second pillar plate 42 configures the right surface of the pillar frame 4. As shown in FIG. 6, the pillar frame 4 has a trapezoid shape in a right side view. A length L6, in the orthogonal direction W, of the lower end of the pillar frame 4 is longer than a length L5, in the orthogonal direction W, of the upper end of the pillar frame 4. The second pillar plate 42 includes a recess 421. The second pillar plate 42 has holes 422 and 423 that penetrate the second pillar plate 42 in the left-right direction. The recess 421 is recessed to the left, at the upper portion of the second pillar plate 42. Ribs 425 and 426 that have an X shape in a right side view are disposed side by side with each other in the up-down direction, in the recess 421. The hole 422 has a rectangular shape in a right side view and is arranged below the recess 421. The hole 423 has a rectangular shape in a right side view and is arranged below the hole 422. In a right side view, a size of the hole 423 is larger than a size of the hole 422. In a case where the sewing machine frame 5 is assembled to the sewing machine 1, the sewing machine motor of the sewing machine 1 is disposed in the hole 422. The power source is disposed in the hole 423.

Figure 8:
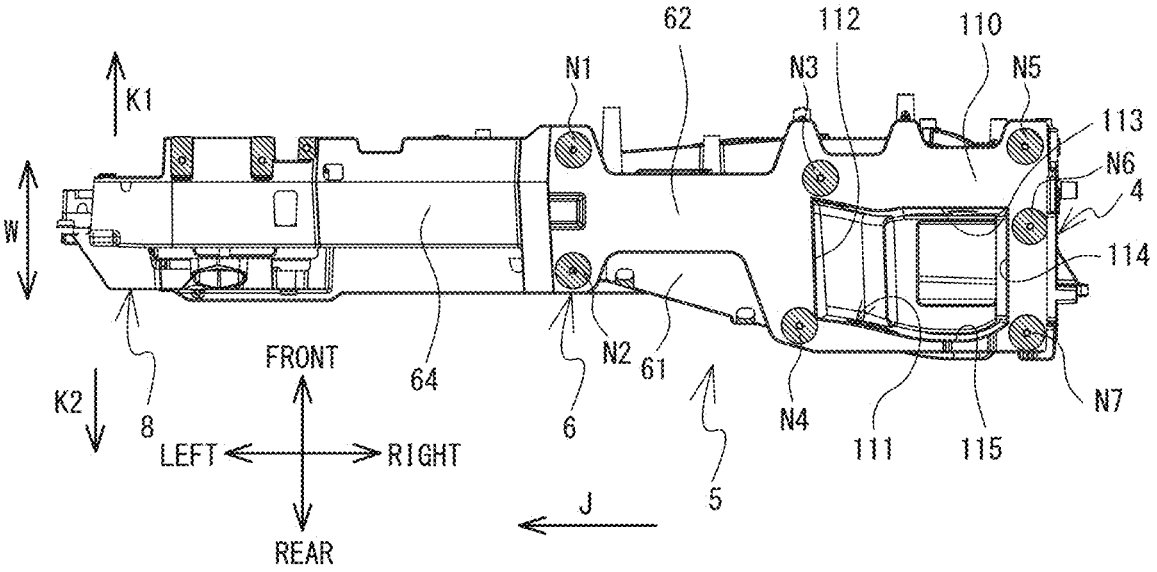
FIG. 8 is a bottom view of the sewing machine frame.

The pillar upper plate 121 extends in the horizontal direction orthogonal to the up-down direction, at the upper end of the pillar frame 4. The pillar upper plate 121 is continuous with a first extending plate 81 of the arm frame 8 to be described later. The pillar lower plate 110 extends in the horizontal direction orthogonal to the up-down direction, at the lower end of the pillar frame 4. The pillar lower plate 110 is continuous with a second bed plate 62 of the bed frame 6 to be described later. As shown in FIG. 8, a pillar hole 111, which penetrates in the up-down direction and has a square shape with curved sides in a bottom view, is arranged in the pillar lower plate 110. Of sides 112 to 115 forming the four sides of the pillar hole 111, the front side 113 and the rear side 115 are curved in an arc shape recessed to the rear in a bottom view. The left side 112 and the right side 114 extend in a straight line shape in the front-rear direction in a bottom view.

Figure 3:
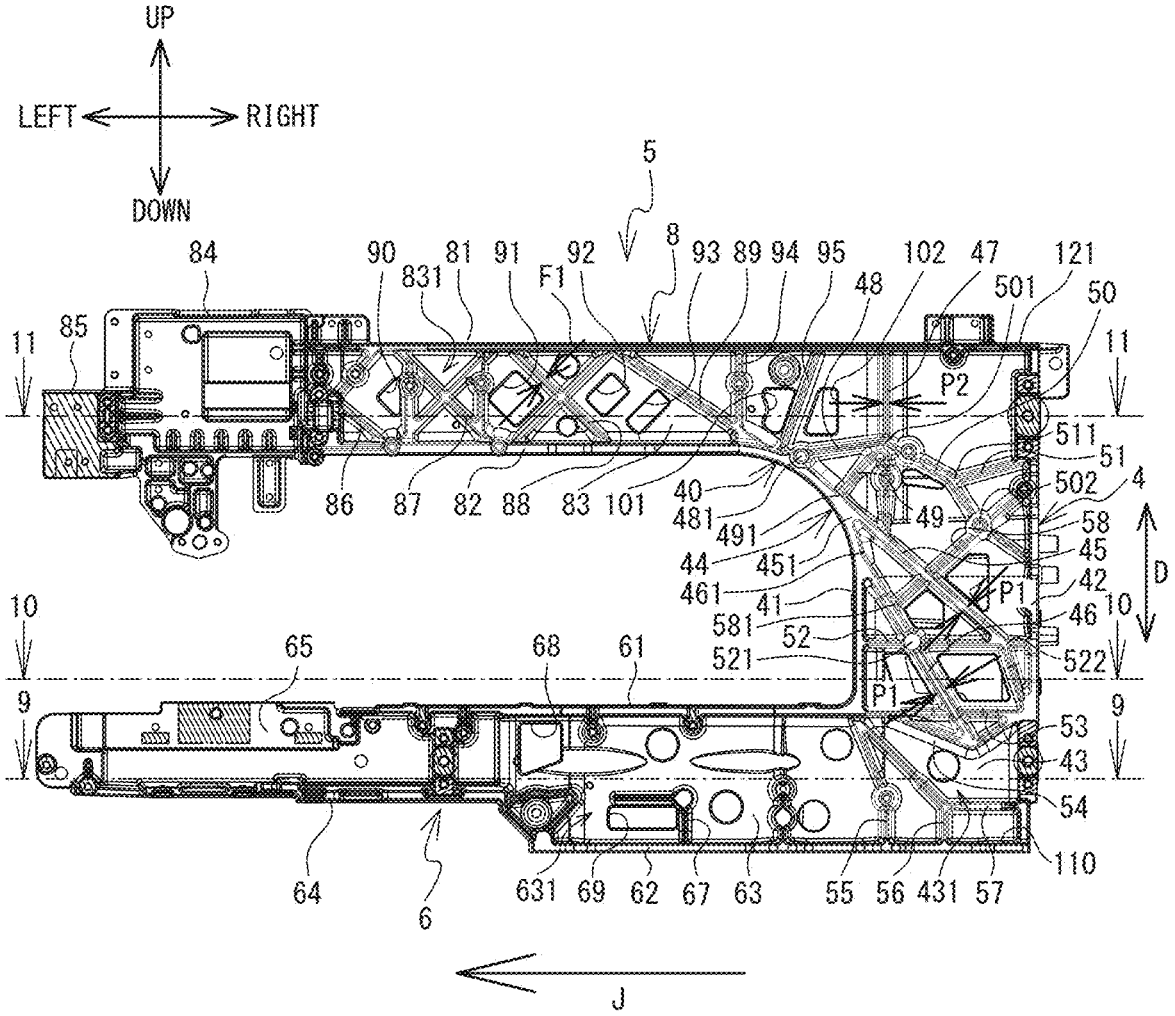
FIG. 3 is a front view of the sewing machine frame.
Figure 9:
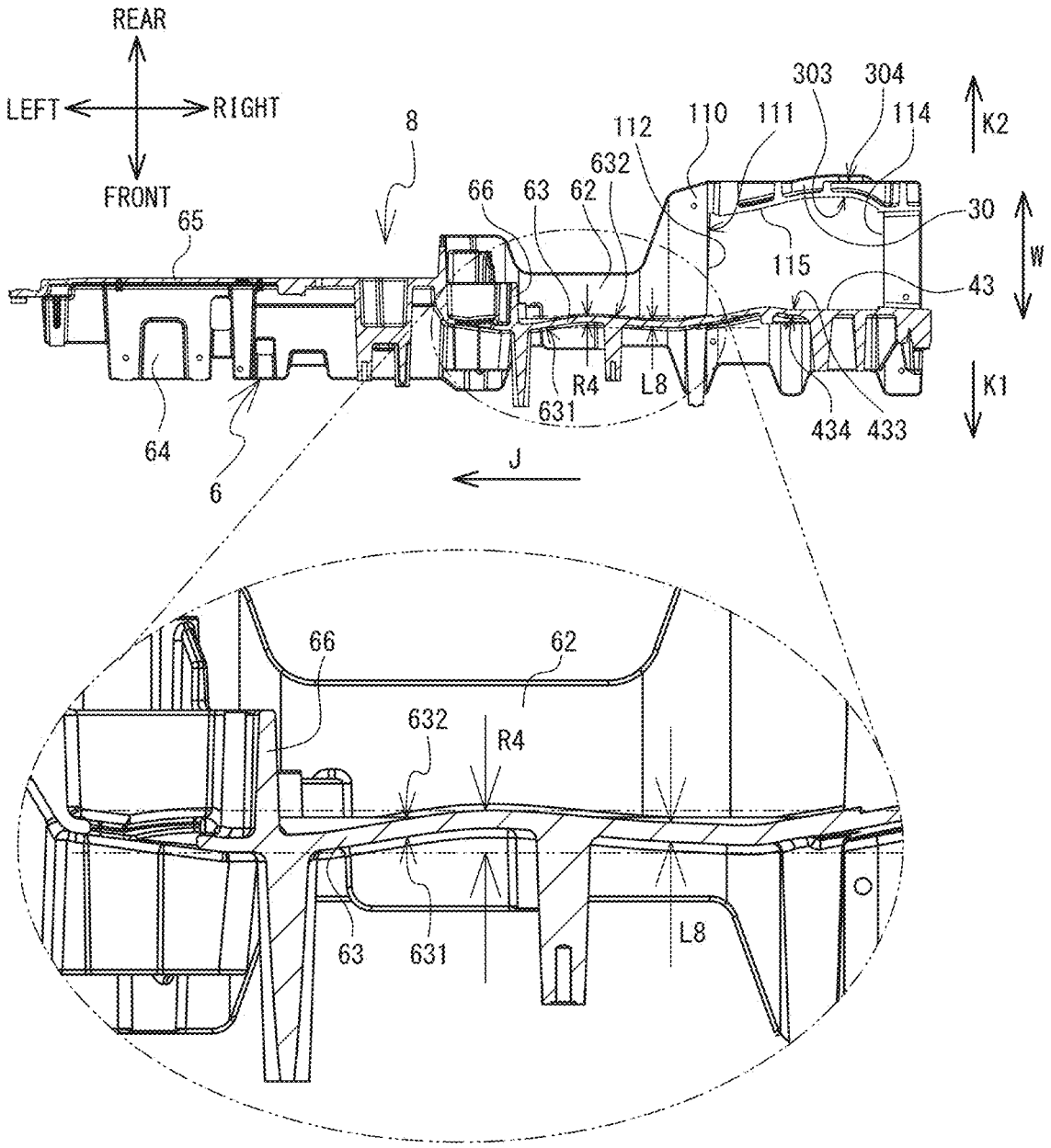
FIG. 9 is a cross-sectional view in the direction of arrows along a line 9-9 shown in FIG. 3.
Figure 10:
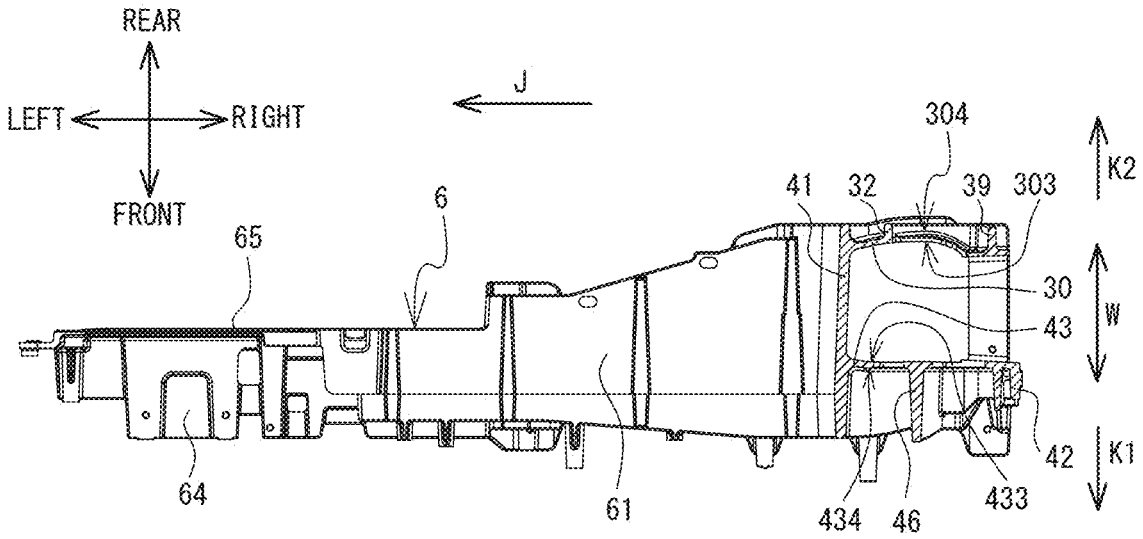
FIG. 10 is a cross-sectional view in the direction of arrows along a line 10-10 shown in FIG. 3.

As shown in FIG. 2 and FIG. 3, the pillar plate 43 extends in the extending direction J and the longitudinal direction D. The pillar plate 43 couples the first pillar plate 41 and the second pillar plate 42 in the left-right direction. As shown in FIG. 9 and FIG. 10, the pillar plate 43 has curved surfaces 433 and 434. The curved surface 433 is the back surface of the pillar plate 43. The curved surface 434 is the front surface of the pillar plate 43. The curved surface 433 extends upward from the curved side 113 of the pillar hole 111. Each of the curved surfaces 433 and 434 has a cross-sectional shape in a plane perpendicular to the longitudinal direction D that is a curved line. The pillar plate 43 is coupled to the first pillar plate 41 at a section separated from each of both ends, in the orthogonal direction W, of the first pillar plate 41. The pillar plate 43 is coupled to the second pillar plate 42 at the rear end, in the orthogonal direction W, of the second pillar plate 42. The pillar plate 43 curves in correspondence to the shape of the sewing machine motor and the power source in a case where the sewing machine frame 5 is assembled to the sewing machine 1. Specifically, as shown in FIG. 4, the pillar plate 43 has a curved shape above the hole 422, extending upward, in the longitudinal direction D, after bending in the second direction K2 above the hole 422. Of the pillar plate 43, a position, in the orthogonal direction W, of a section 431 above the hole 422 is positioned further to the rear than a section 432 below the hole 422. The section 431 is coupled to an extending intermediate plate 83.

Figure 7:
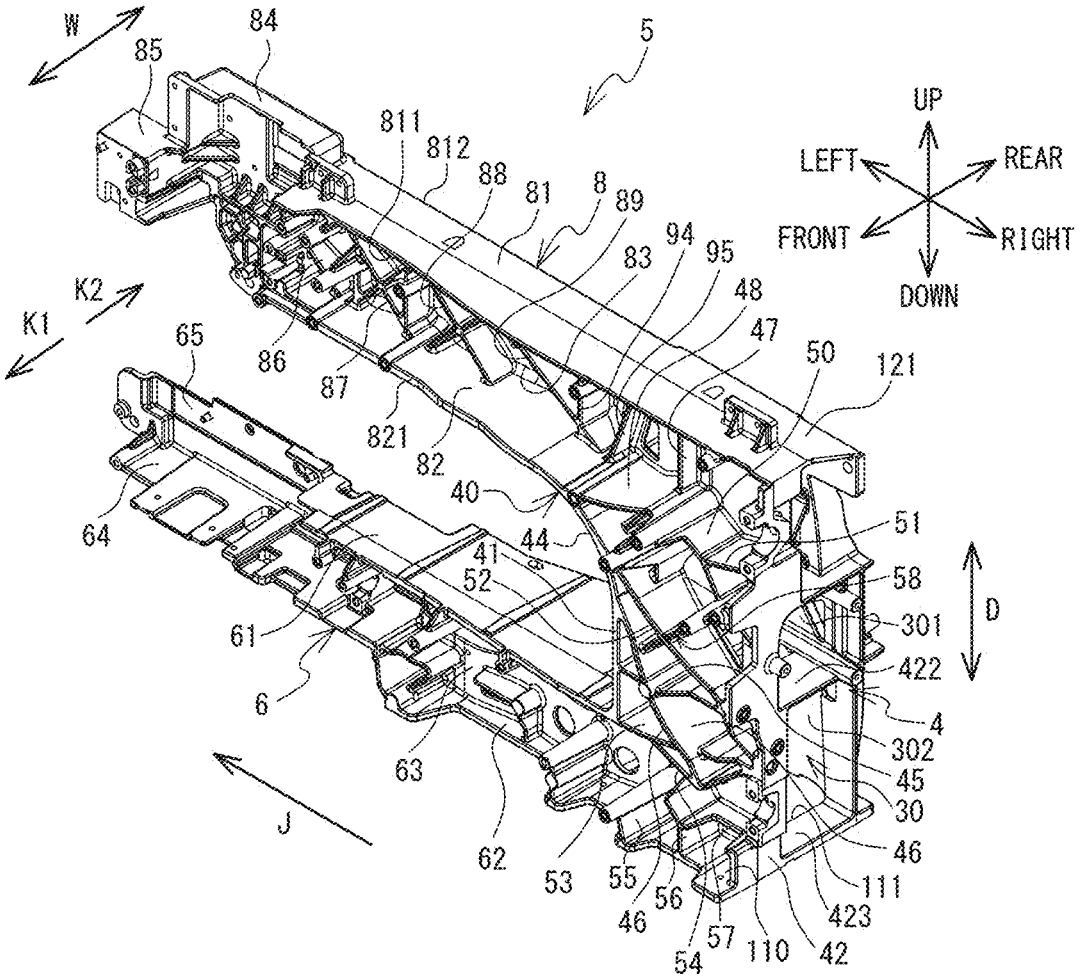
FIG. 7 is a perspective view of the sewing machine frame.

As shown in FIG. 4 and FIG. 5, the pillar plate 30 extends in the extending direction J and the longitudinal direction D. The pillar plate 30 couples the first pillar plate 41 and the second pillar plate 42 in the left-right direction. As shown in FIG. 9 and FIG. 10, the pillar plate 30 has curved surfaces 303 and 304. The curved surface 303 is the front surface of the pillar plate 30. The curved surface 304 is the back surface of the pillar plate 30. The curved surface 303 extends upward from the curved side 115 of the pillar hole 111. Each of the curved surfaces 303 and 304 has a cross-sectional shape in a plane perpendicular to the longitudinal direction D that is a curved line. The pillar plate 30 is coupled to the first pillar plate 41 further to the rear than the pillar plate 43, and at a section separated from each of both the ends, in the orthogonal direction W, of the first pillar plate 41. The pillar plate 30 is not coupled to the second pillar plate 42. The pillar plate 30 curves in correspondence to the shape of the sewing machine motor and the power source in a case where the sewing machine frame 5 is assembled to the sewing machine 1. Specifically, as shown in FIG. 7, the pillar plate 30 has a curved shape above the hole 423, extending upward, in the longitudinal direction D, after bending in the first direction K1 above the hole 423. Of the pillar plate 30, a position, in the orthogonal direction W, of a section 301 above the hole 423 is positioned further to the front than a section 302 below the hole 423. A distance in the orthogonal direction W between the pillar plate 43 and the pillar plate 30 becomes larger in order of the recess 421, the hole 422, and the hole 423.

As shown in FIG. 2, FIG. 3, and FIG. 7, the first pillar ribs 45 and 46, and the second pillar ribs 47 to 58 protrude to the front from the front surface of the pillar plate 43. The first pillar ribs 45 and 46 are disposed on tangent lines of the coupling curved plate 44 in a front view. The coupling curved plate 44 includes a coupling portion 451 at which the coupling curved plate 44 is coupled to the first pillar rib 45, a coupling portion 461 at which the coupling curved plate 44 is coupled to the first pillar rib 46, a coupling portion 481 at which the coupling curved plate 44 is coupled to the second pillar rib 48, and a coupling portion 491 at which the coupling curved plate 44 is coupled to the second pillar rib 49. The first pillar rib 45 extends downward to the right from the coupling portion 451 of the coupling curved plate 44. The first pillar rib 46 extends downward to the right from the coupling portion 461 positioned lower than the first pillar rib 45. An extending angle, with respect to the horizontal direction, of the first pillar rib 45 in the clockwise direction in a front view is smaller than an extending angle, with respect to the horizontal direction, of the first pillar rib 46 in the clockwise direction in a front view.

The second pillar rib 47 extends in the up-down direction at the upper portion of the pillar frame 4. The upper end of the second pillar rib 47 is coupled to the pillar upper plate 121. The lower end of the second pillar rib 47 is coupled to the first pillar rib 45. The second pillar rib 48 extends to the right from the coupling portion 481 positioned at the left end portion of the coupling curved plate 44. The right end of the second pillar rib 48 is coupled to the second pillar rib 47. The second pillar rib 49 extends upward to the right from the coupling portion 491. The coupling portion 491 is positioned between the coupling portion 481 and the coupling portion 451 in the coupling curved plate 44. The right end of the second pillar rib 49 is coupled to the right end of the second pillar rib 48 and to the second pillar rib 47. The second pillar rib 50 extends downward to the right from a coupling portion 501 at which the second pillar rib 47 is coupled to the second pillar ribs 48 and 49. The second pillar rib 50 intersects the second pillar rib 58 to be described later. The second pillar rib 50 includes an intersection portion 502 that intersects the second pillar rib 58. The right end of the second pillar rib 50 is coupled to the second pillar plate 42. The second pillar rib 50 includes a coupling portion 511 at which the second pillar rib 50 is coupled to the second pillar rib 51, between the intersection portion 502 and the coupling portion 501 that is the left end of the second pillar rib 50. The second pillar rib 51 extends upward to the right from the coupling portion 511. The right end of the second pillar rib 51 is coupled to the second pillar plate 42.

The second pillar rib 52 extends in the left-right direction at a position lower than the left end of the first pillar rib 46. The left end of the second pillar rib 52 is coupled to the first pillar plate 41. The right end of the second pillar rib 52 is coupled to the second pillar plate 42. The second pillar rib 52 includes an intersection portion 521 that intersects the first pillar rib 45, and an intersection portion 522 that intersects the first pillar rib 46. The second pillar rib 53 extends in the left-right direction at a position lower than the second pillar rib 52. The left end of the second pillar rib 53 is coupled to the first pillar plate 41. The right end of the second pillar rib 53 is coupled to the second pillar plate 42. The second pillar rib 53 intersects the first pillar rib 46. The second pillar rib 54 is coupled to the lower end of the first pillar rib 45. The position of the second pillar rib 53 in the longitudinal direction D is substantially the same as the position, in the longitudinal direction D, of a first bed plate 61 of the bed frame 6 to be described later. The second pillar rib 54 extends in a V shape in a front view, below the second pillar rib 53. The second pillar rib 54 is coupled to the lower ends of the first pillar ribs 45 and 46. The left end and the right end of the second pillar rib 54 are coupled to the second pillar rib 53.

Each of the second pillar ribs 55 and 56 extends downward to the right from the lower end of the first pillar plate 41. The lower end of the second pillar rib 55 and the lower end of the second pillar rib 56 are coupled to the pillar lower plate 110. The lower end of the second pillar rib 55 is positioned further in the extending direction J than the lower end of the second pillar rib 56. The second pillar rib 57 extends in the left-right direction below the second pillar rib 53. The left end of the second pillar rib 57 is coupled to the second pillar rib 56. The right end of the second pillar rib 57 is coupled to the second pillar plate 42. The first pillar rib 46 includes a coupling portion 581 at which the first pillar rib 46 is coupled to the second pillar rib 58, between the coupling portion 461 and the intersection portion 521. The second pillar rib 58 extends upward to the right from the coupling portion 581. The second pillar rib 58 intersects each of the second pillar rib 50 and the first pillar rib 45. The right end of the second pillar rib 58 is coupled to the second pillar plate 42.

The lengths of the first pillar ribs 45 and 46, in the longitudinal direction D, are longer than the lengths of the second pillar ribs 47 to 58 in the longitudinal direction D. In a cross-sectional shape perpendicular to the orthogonal direction W, the thickness of the first pillar ribs 45 and 46 is greater than the thickness of the second pillar ribs 47 to 58. The thicknesses of the first pillar ribs 45 and 46 may be the same as each other, or may differ from each other. The thicknesses of the second pillar ribs 47 to 58 may be the same as each other or may differ from each other. The thickness of the first pillar ribs 45 and 46 is preferably in a range of 1.2 times to 3.0 times the thickness of the second pillar ribs 47 to 58. A thickness P1 of the first pillar ribs 45 and 46 is 5 mm, for example, and a thickness P2 of the second pillar ribs 47 to 58 is 3 mm, for example. A protrusion amount, in the orthogonal direction W, of the first pillar ribs 45 and 46 is greater than a protrusion amount, in the orthogonal direction W, of arm ribs 86 to 89, 94, and 95, to be described later.

As shown in FIG. 4 and FIG. 5, the first pillar ribs 31, 32, and 39, and the second pillar ribs 33 to 38 protrude to the rear from the back surface of the pillar plate 30. The coupling curved plate 44 includes a coupling portion 341 at which the coupling curved plate 44 is coupled to the second pillar rib 34, a coupling portion 351 at which the coupling curved plate 44 is coupled to the second pillar rib 35, a coupling portion 311 at which the coupling curved plate 44 is coupled to the first pillar rib 31, and a coupling portion 321 at which the coupling curved plate 44 is coupled to the first pillar rib 32. The first pillar ribs 31 and 32 are disposed on tangent lines of the coupling curved plate 44 in a back view. The first pillar rib 31 extends downward to the right from the coupling portion 311 of the coupling curved plate 44. The first pillar rib 32 extends downward to the right, from the coupling portion 321 of the coupling curved plate 44, at a position lower than the first pillar rib 31. The first pillar rib 39 extends in the longitudinal direction D, at the right end portion of the back surface of the pillar frame 4. The upper end of the first pillar rib 39 is coupled to the pillar upper plate 121, and the lower end of the first pillar rib 39 is coupled to the pillar lower plate 110. The first pillar rib 39 is coupled to each of the right end of the first pillar rib 31 and the right end of the first pillar rib 32.

The second pillar rib 33 extends in an arc shape that is convex upward and to the right, at the upper portion of the pillar frame 4. The upper end of the second pillar rib 33 is coupled to the pillar upper plate 121. The lower end of the second pillar rib 33 is coupled to the first pillar rib 39. The second pillar rib 34 extends upward to the right from the coupling portion 341 of the coupling curved plate 44. The upper end of the second pillar rib 34 is coupled to the upper end of the second pillar rib 33. The coupling portion 351 is disposed between the coupling portion 341 and the coupling portion 311. The second pillar rib 35 extends upward to the right from the coupling portion 351. The right end of the second pillar rib 35 is coupled to the second pillar rib 33. The second pillar rib 36 extends downward to the right, at a position below the second pillar rib 35. The right end of the second pillar rib 36 is coupled to the first pillar rib 39. The left end of the second pillar rib 36 is coupled to the first pillar rib 32. The second pillar rib 36 intersects the first pillar rib 31. The second pillar rib 37 extends in the left-right direction at a position below the second pillar rib 36. The second pillar rib 37 intersects the first pillar rib 39. The left end of the second pillar rib 37 is coupled to the first pillar plate 41. The second pillar rib 37 is coupled to the lower end of the first pillar rib 31. The second pillar rib 37 intersects the first pillar rib 32. The second pillar rib 38 extends downward to the right from the lower end of the first pillar plate 41. The lower end of the second pillar rib 38 is coupled to the lower end of the first pillar rib 39 and to the pillar lower plate 110.

Each of the lengths of the first pillar ribs 31, 32 and 39, in the longitudinal direction D, is longer than the each of lengths of the second pillar ribs 33 to 38 in the longitudinal direction D. In a cross-sectional shape perpendicular to the orthogonal direction W, the thickness of the first pillar ribs 31, 32, and 39 is greater than the thickness of the second pillar ribs 33 to 38. The thicknesses of the first pillar ribs 31, 32, and 39 may be the same as each other, or may differ from each other. The thickness of the first pillar ribs 31, 32, and 39 is preferably in a range of 1.2 times to 3.0 times the thickness of the second pillar ribs 33 to 38. A thickness Q1 of the first pillar ribs 31, 32, and 39 is 5 mm, for example, and a thickness Q2 of the second pillar ribs 33 to 38 is 3 mm, for example. Holes 101 and 102 that penetrate the pillar plate 43 in the orthogonal direction W are arranged in the pillar plate 43. Holes 103 to 108 that penetrate the pillar plate 30 in the orthogonal direction W are arranged in the pillar plate 30.

As shown in FIG. 2 to FIG. 5, the bed frame 6 extends in the extending direction J from the lower end of the pillar frame 4 and faces the arm frame 8. The bed frame 6 includes a first bed plate 61, the second bed plate 62, a bed intermediate plate 63, bed ribs 66 and 67, and shuttle support plates 64 and 65. The first bed plate 61 extends in the orthogonal direction W and the extending direction J. The length, in the orthogonal direction W, of the first bed plate 61 is shorter at a portion closer to the tip end in the extending direction J than at a portion closer to the rear end in the extending direction J. In other words, the length, in the orthogonal direction W, of the left end portion of the first bed plate 61 is shorter than the length, in the orthogonal direction W, of the right end portion of the first bed plate 61. The second bed plate 62 is separated from the first bed plate 61 in the longitudinal direction D, faces the first bed plate 61, and extends in the orthogonal direction W and the extending direction J. The length, in the orthogonal direction W, of the second bed plate 62 is shorter than the length, in the orthogonal direction W, of the first bed plate 61. The bed intermediate plate 63 extends in the longitudinal direction D and the extending direction J. The bed intermediate plate 63 couples the first bed plate 61 and the second bed plate 62 in the longitudinal direction D. The bed intermediate plate 63 is coupled to the pillar plate 43. As shown in FIG. 9, the bed intermediate plate 63 has curved surfaces 631 and 632, each having a shape in a cross-section perpendicular to the longitudinal direction D that is a curved line. The curved surface 631 is the front surface of the bed intermediate plate 63. The curved surface 632 is the back surface of the bed intermediate plate 63. The bed intermediate plate 63 according to the present embodiment extends in the extending direction J while bending once or more in the orthogonal direction W. A length R4 of a range in which the bed intermediate plate 63 extends in the orthogonal direction W is smaller than half the length of a range in which the first bed plate 61 extends in the orthogonal direction W, and is smaller than half the length of a range in which the second bed plate 62 extends in the orthogonal direction W. In the present embodiment, the length R4 of the range in which the bed intermediate plate 63 extends in the orthogonal direction W is greater than 1.2 times a thickness L8 of the bed intermediate plate 63, and, more specifically, is greater than 1.7 times the thickness L8 of the bed intermediate plate 63.

As shown in FIG. 2 and FIG. 3, the bed rib 67 protrudes to the front from the front surface of the bed intermediate plate 63. The bed rib 67 curves in an L shape in a front view. The lower end of the bed rib 67 is coupled to the second bed plate 62. The bed intermediate plate 63 has a hole 69 along the bed rib 67. As shown in FIG. 4 and FIG. 5, the bed rib 66 protrudes to the rear from the back surface of the bed intermediate plate 63. The bed rib 66 extends in a Y shape in a back view. The upper end of the bed rib 66 is coupled to the first bed plate 61. The lower end of the bed rib 66 is coupled to the second bed plate 62. The left end of the bed rib 66 is coupled to the shuttle support plate 65. The bed intermediate plate 63 has a hole 68 arranged along the bed rib 66.

The shuttle support plates 64 and 65 are disposed at the tip end of the bed frame 6 in the extending direction J. The shuttle support plates 64 and 65 support the shuttle mechanism of the sewing machine 1. The shuttle support plate 64 is coupled to the tip end, in the extending direction J, of the second bed plate 62, extends in the horizontal direction, and extends in the extending direction J. The position of the shuttle support plate 64 in the up-down direction is located higher than the position of the second bed plate 62 in the up-down direction. The shuttle support plate 65 extends upward from the rear end of the shuttle support plate 64. The shuttle support plate 65 is coupled to the tip end of the bed intermediate plate 63 in the extending direction J. A shape of the shuttle support plate 65 in a cross-section perpendicular to the longitudinal direction D is a straight line shape in a plan view.

The arm frame 8 includes the first extending plate 81, a second extending plate 82, the extending intermediate plate 83, arm ribs 86 to 89 and 94 to 100, a head frame 84, and a projector support plate 85. The first extending plate 81 extends in the horizontal direction, and extends in the extending direction J. The first extending plate 81 is coupled to the tip end of the pillar upper plate 121 in the extending direction J. The second extending plate 82 is separated from the first extending plate 81 in the longitudinal direction D, faces the first extending plate 81, extends in the horizontal direction, and extends in the extending direction J. The second extending plate 82 is coupled to the tip end of the coupling curved plate 44 in the extending direction J. The extending intermediate plate 83 extends in the longitudinal direction D and the extending direction J. The extending intermediate plate 83 couples the first extending plate 81 and the second extending plate 82 in the longitudinal direction D. The extending intermediate plate 83 is coupled to the pillar plate 43.

Figure 11:
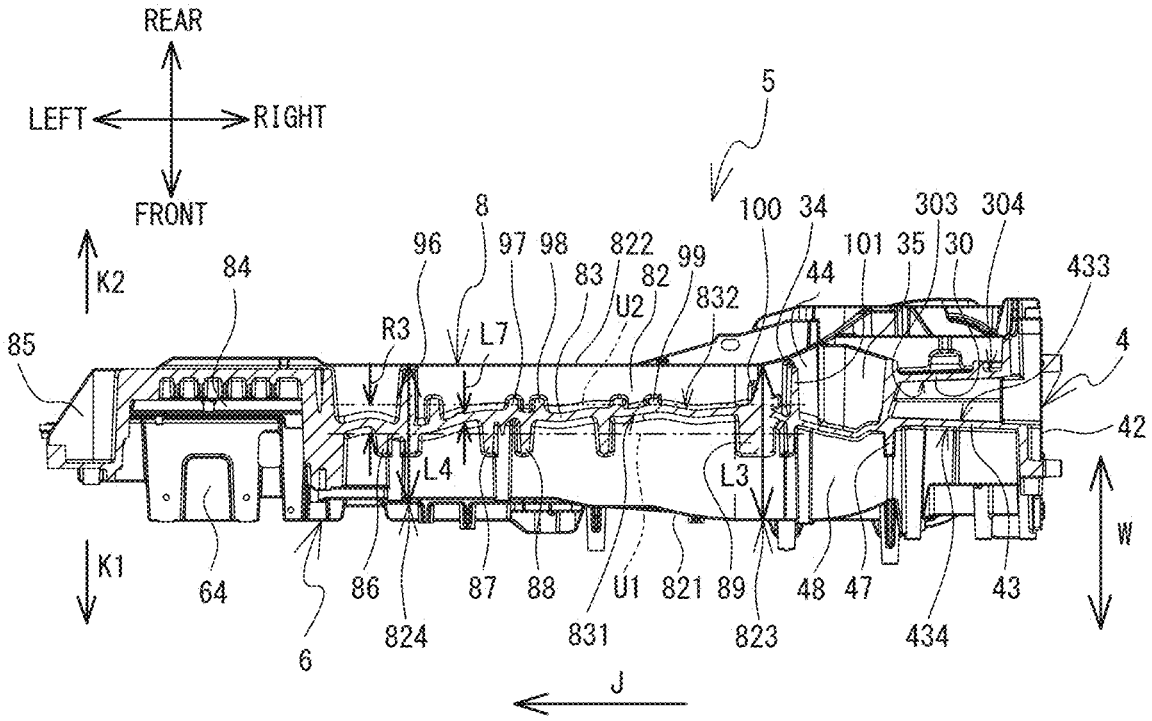
FIG. 11 is a cross-sectional view in the direction of arrows along a line 11-11 shown in FIG. 3.
Figure 12:
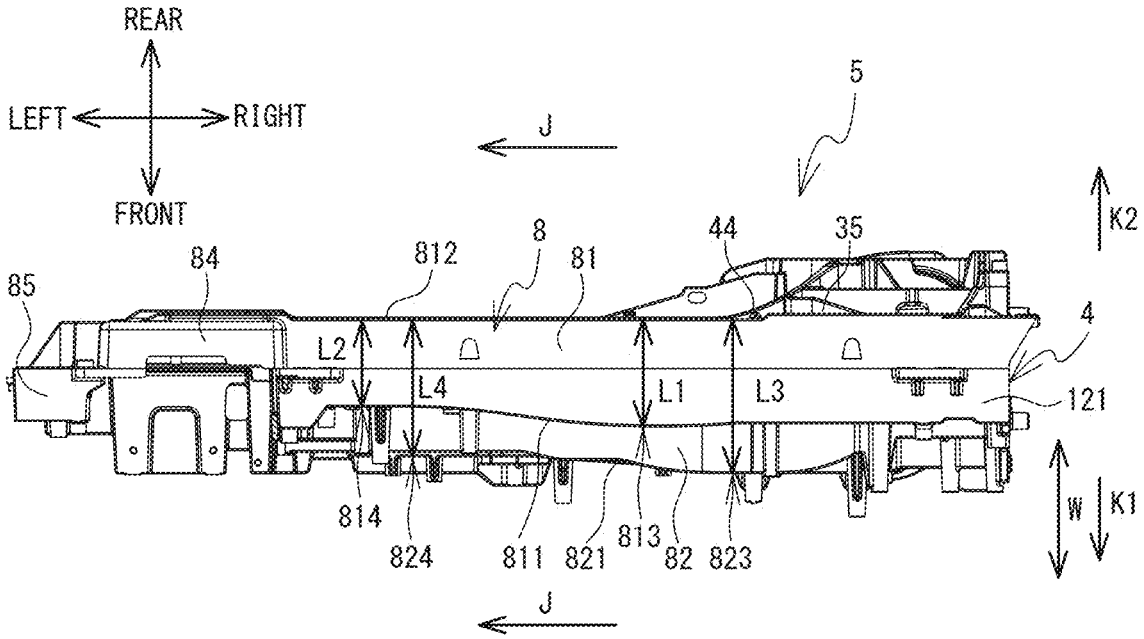
FIG. 12 is a plan view of the sewing machine frame.

As shown in FIG. 11 and FIG. 12, a first contour that is a contour of an end 811 of the first extending plate 81 in the first direction K1 is a curved line in a plan view. A contour of an end 812 of the first extending plate 81 in the second direction K2 is a straight line in a plan view. A second contour that is a contour of an end 821 of the second extending plate 82 in the first direction K1 is a curved line in a plan view. A contour of an end 822 of the second extending plate 82 in the second direction K2 is a straight line in a plan view. The end 821 of the second extending plate 82 is positioned further in the first direction K1 than the end 811 of the first extending plate 81. The length of the first extending plate 81 in the orthogonal direction W is a longest length L1 at a section 813 and is a shortest length L2 at a section 814. In the first extending plate 81, the section 814 at which the length of the first extending plate 81 is shortest in the orthogonal direction W is positioned further in the extending direction J than the section 813 at which the length of the first extending plate 81 is longest in the orthogonal direction W. The length of the second extending plate 82 in the orthogonal direction W is a longest length L3 at a section 823 and is a shortest length L4 at a section 824. In the second extending plate 82, the section 823 at which the length of the second extending plate 82 is shortest in the orthogonal direction W is positioned further in the extending direction J than the section 824 at which the length of the second extending plate 82 is longest in the orthogonal direction W. With respect to each of the length of the first extending plate 81 and the length of the second extending plate 82 in the orthogonal direction W, the lengths are shorter at a portion closer to the tip end in the extending direction J than at a portion closer to the rear end in the extending direction J.

As shown in FIG. 11, the extending intermediate plate 83 has curved surfaces 831 and 832. The curved surface 831 is the front surface of the extending intermediate plate 83. The curved surface 832 is the back surface of the extending intermediate plate 83. Each of the curved surfaces 831 and 832 has a cross-sectional shape in a plane perpendicular to the longitudinal direction D, namely, in a cross-section extending in the horizontal direction, that is a curved line. The extending intermediate plate 83 is coupled to the first extending plate 81 at a section separated from each of both ends of the first extending plate 81 in the orthogonal direction W. The extending intermediate plate 83 is coupled to the second extending plate 82 at a section separated from each of both ends of the second extending plate 82 in the orthogonal direction W.

A length R3 of a range in which the extending intermediate plate 83 extends in the orthogonal direction W is smaller than half the length of a range in which the first extending plate 81 extends in the orthogonal direction W, and is smaller than half the length of a range in which the second extending plate 82 extends in the orthogonal direction W. Since the end 812 of the first extending plate 81 extends in a straight line in a plan view, the length of the range in which the first extending plate 81 extends in the orthogonal direction W is the length L1 of the section 813. Since the end 822 of the second extending plate 82 extends in a straight line in a plan view, the length of the range the second extending plate 82 extends in the orthogonal direction W is the length L3 of the section 823. The length R3 of the range in which the extending intermediate plate 83 according to the present embodiment extends in the orthogonal direction W is greater than 1.2 times a thickness L7 of the extending intermediate plate 83, and, more specifically, is greater than 1.7 times the thickness L7 of the extending intermediate plate 83. The tip end of the extending intermediate plate 83 in the extending direction J is disposed, in the orthogonal direction W, in the vicinity of the center of the second extending plate 82 in the orthogonal direction W. The rear end in the extending direction J of the extending intermediate plate 83 is disposed, in the orthogonal direction W, further to the rear than the center of the second extending plate 82 in the orthogonal direction W. A cross section of the extending intermediate plate 83 extending in the horizontal direction includes a plurality of convex portions that are protrusions in the orthogonal direction W, in a plan view. Virtual lines U1 and U2 that extend in the extending direction J are used for defining the range in which the extending intermediate plate 83 extends in the orthogonal direction W, and, of the front surface and the back surface of the extending intermediate plate 83, a surface area of sections touching the virtual lines U1 and U2 is smaller than a surface area of sections separated from the virtual lines U1 and U2. At the front surface and back surface of the extending intermediate plate 83, a surface area of sections that are flat surfaces is smaller than a surface area of sections that are curved surfaces. The extending intermediate plate 83 according to the present embodiment extends in the extending direction J while being bent a plurality of times in the orthogonal direction W, but the extending intermediate plate 83 is not limited to this configuration, and it is sufficient that the extending intermediate plate 83 has curved surfaces extending in the extending direction J that are bent at least once.

As shown in FIG. 2 and FIG. 3, the arm ribs 86 to 89, 94, and 95 protrude to the front along the orthogonal direction W, from the front surface of the extending intermediate plate 83. The arm rib 86 is a rib that is bent in an L shape in a front view. The upper end of the arm rib 86 is coupled to the first extending plate 81, and the lower end of the arm rib 86 is coupled to the second extending plate 82. The arm ribs 87 and 88 are ribs having an X shape in a front view. Each of the upper ends of the arm ribs 87 and 88 is coupled to the first extending plate 81, and each of the lower ends of the arm ribs 87 and 88 is coupled to the second extending plate 82. In the extending direction J, the arm rib 87 is disposed between the arm rib 86 and the arm rib 88. The arm rib 89 extends upward and to the left from the tip end portion, in the extending direction J, of the coupling curved plate 44. The upper end of the arm rib 89 is coupled to the first extending plate 81 and the lower end of the arm rib 89 is coupled to the second extending plate 82. The arm rib 89 is disposed on the same tangent line, of the coupling curved plate 44, as the tangent line on which the first pillar rib 45 is disposed. The arm rib 94 extends upward from the lower end of the arm rib 89. The upper end of the arm rib 94 is coupled to the first extending plate 81. The arm rib 95 extends upward and to the right from a position to the left of the coupling portion 481. The upper end of the arm rib 95 is coupled to the first extending plate 81. The thicknesses of the arm ribs 86 to 89, 94, and 95 may be the same as each other, or may differ from each other. The thickness P1 of the first pillar ribs 45 and 46 is greater than a thickness F1 of the arm ribs 86 to 89, 94, and 95. The thickness P2 of the second pillar ribs 47 to 58 is smaller than the thickness P1 of the first pillar ribs 45 and 46. The thickness F1 of the arm ribs 86 to 89, 94, and 95 according to the present embodiment is the same as the thickness P2 of the second pillar ribs 47 to 58, and is 3 mm, for example. The thickness F1 of the arm ribs 86 to 89, 94, and 95 may be different from the thickness P2 of the second pillar ribs 47 to 58.

As shown in FIG. 4 and FIG. 5, the arm ribs 96 to 100 protrude to the rear along the orthogonal direction W from the rear surface of the extending intermediate plate 83. Each of the arm ribs 96 to 99 is a rib having an X shape in a rear view. The arm rib 100 extends in the longitudinal direction D. The arm ribs 96 to 100 are aligned, in that order, respectively, from the tip end to the rear end in the extending direction J. Each of the upper ends of the arm ribs 96 to 100 is coupled to the first extending plate 81, and each of the lower ends of the arm ribs 96 to 100 is coupled to the second extending plate 82. The thicknesses of the arm ribs 96 to 100 may be the same as each other or may differ from each other. The thickness of the arm ribs 96 to 100 is smaller than the thickness of the first pillar ribs 31, 32, and 39. A protrusion amount of the arm rib 96 in the orthogonal direction W is greater than a protrusion amount of the arm ribs 97 to 100 in the orthogonal direction W. The thickness Q1 of the first pillar ribs 31, 32, and 39 is greater than a thickness F2 of the arm ribs 96 to 100. The thickness Q2 of the second pillar ribs 33 to 38 is smaller than the thickness Q1 of the first pillar ribs 31, 32, and 39. The thickness F2 of the arm ribs 96 to 100 according to the present embodiment is the same as the thickness Q2 of the second pillar ribs 33 to 38, and is 3 mm, for example. The thickness F2 of the arm ribs 96 to 100 may be different from the thickness Q2 of the second pillar ribs 33 to 38. The protrusion amount to the rear of the arm ribs 96 to 100 is smaller than the protrusion amount to the front of the arm ribs 86 to 89, 94, and 95.

A plurality of holes 90 to 93 that penetrate in the orthogonal direction W are arranged in the extending intermediate plate 83. The hole 90 is arranged along the arm rib 96 and has a triangular shape in a front view. The hole 91 is arranged along the arm ribs 88 and 97 and has a rectangular shape in a front view. The hole 92 is arranged along the arm ribs 88 and 98 and has a rectangular shape in a front view. The hole 93 is arranged along the arm ribs 89 and 99 and has a rectangular shape in a front view.

The head frame 84 is disposed at the tip end portion of the arm frame 8 in the extending direction J. The head frame 84 has a U shape that is open to the front in a plan view. In a case where the sewing machine frame 5 is assembled to the sewing machine 1, the head frame 84 supports the needle bar mechanism 21 and the thread take-up lever mechanism 23. The projector support plate 85 is coupled to the tip end of the head frame 84 in the extending direction J. In a case where the sewing machine frame 5 is assembled to the sewing machine 1, the projector support plate 85 supports the projector module 20 at a position further in the extending direction J than the needle bar mechanism 21.

The rigidity and lightweightness of the sewing machine frame 5 according to the present embodiment were evaluated. The sewing machine frame 5 having the above-described configuration was used as a working example. A known sewing machine frame having a configuration in which the size of the sewing machine frame is the same in the longitudinal direction D and in the extending direction J as the size of the sewing machine frame 5 according to the working example, such as a sewing machine frame having the same configuration as a sewing machine frame of a sewing machine disclosed in Japanese Unexamined Patent Application Publication No. 2020-55694 for example, was used as a comparative example. The same conditions were applied for the materials used for the sewing machine frame according to the comparative example and for the sewing machine frame 5 according to the working example. In the sewing machine frame according to the comparative example, both of a bed intermediate plate, and an extending intermediate plate is a flat plate extending in the extending direction J. The number of ribs of the sewing machine frame according to the comparative example is greater than the number of ribs of the sewing machine frame 5. In the evaluation of the rigidity of the working example, sections N1 to N7 of the bed frame 6 and the bottom portion of the pillar frame 4 shown in FIG. 8 were fixed, and a displacement amount of the sewing machine frame 5 was measured, using a simulator, in a case where a load of 10 N was applied downward and to the front, respectively, at each of a tip end portion M1 of the arm frame 8 shown in FIG. 4, and a tip end portion M2 of the bed frame 6. The evaluation of the rigidity of the comparative example was performed using the same method as for the working example. The sewing machine frame 5 of the working example was able to increase the rigidity by 1.4 times, while achieving a 68% weight reduction with respect to the sewing machine frame of the comparative example.

The sewing machine frame 5 according to the above-described embodiment includes the pillar frame 4 and the arm frame 8. The arm frame 8 extends from the pillar frame 4 in the extending direction J orthogonal to the longitudinal direction D of the pillar frame 4. The arm frame 8 includes the first extending plate 81, the second extending plate 82, and the extending intermediate plate 83. The first extending plate 81 extends in the extending direction J. The second extending plate 82 is separated from the first extending plate 81 in the longitudinal direction D, faces the first extending plate 81, and extends in the extending direction J. The extending intermediate plate 83 extends in the extending direction J and couples the first extending plate 81 and the second extending plate 82. The extending intermediate plate 83 has the curved surfaces 831 and 832, each of the curved surfaces 831 and 832 has a shape in a cross-section perpendicular to the longitudinal direction D that is a curved line.

The sewing machine frame 5 includes the pillar frame 4, and with the arm frame 8 extending, from the one end of the pillar frame 4 in the longitudinal direction D, in the extending direction J orthogonal to the longitudinal direction D. The arm frame 8 includes the first extending plate 81, the second extending plate 82, and the extending intermediate plate 83. The first extending plate 81 extends in the extending direction J. The second extending plate 82 is separated from the first extending plate 81 in the longitudinal direction D, faces the first extending plate 81, and extends in the extending direction J. The extending intermediate plate 83 extends in the longitudinal direction D and the extending direction J. The extending intermediate plate 83 couples the first extending plate 81 and the second extending plate 82 in the longitudinal direction D. The extending intermediate plate 83 has the curved surfaces 831 and 832. In the sewing machine frame 5 that is susceptible to a load acting thereon due to the driving of the sewing machine 1, compared to a case in which the extending intermediate plate 83 only has flat surfaces, the extending intermediate plate 83 of the sewing machine frame 5 contributes to increasing the rigidity of the arm frame 8 without causing an increase in weight. In other words, the extending intermediate plate 83 of the sewing machine frame 5 contributes to achieving both rigidity and lightweightness, compared to the known art.

Each of the curved surfaces 831 and 832 has the cross-sectional shape as the curved line in a plane perpendicular to the longitudinal direction. Compared to a case in which a shape in a cross-section perpendicular to the longitudinal direction D is a flat surface, the extending intermediate plate 83 can increase the rigidity with respect to a load applied in the longitudinal direction D and can couple the first extending plate 81 and the second extending plate 82 in a strong manner.

The longitudinal direction D of the pillar frame 4 is defined as the up-down direction. The arm frame 8 extends in the extending direction J from the upper end of the pillar frame 4. The sewing machine frame 5 includes the bed frame 6 that extends in the extending direction J from the lower end of the pillar frame 4 and faces the arm frame 8. Compared to a case in which the extending intermediate plate 83 only has flat surfaces, the extending intermediate plate 83 of the sewing machine frame 5 contributes to increasing the rigidity of the arm frame 8 that is susceptible to a load acting thereon due to the driving of the sewing machine 1.

In the case where the longitudinal direction D of the pillar frame 4 is defined as the up-down direction, and the direction orthogonal to each of the longitudinal direction D and the extending direction J is defined as the orthogonal direction W, the orthogonal direction W includes the first direction K1 and the second direction K2 opposite to the first direction K1. The first contour that is the contour of the end 811 of the first extending plate 81 in the first direction K1 is the curved line in a plan view, and the second contour that is the contour of the end 821 of the second extending plate 82 in the first direction K1 is the curved line in a plan view. Compared to a case in which the first contour and the second contour are straight lines in a plan view, the first extending plate 81 and the second extending plate 82 of the sewing machine frame 5 contribute to increasing the rigidity of the arm frame 8.

In the first extending plate 81, the section 814 at which the length of the first extending plate 81 is shortest in the orthogonal direction W is positioned further in the extending direction J than the section 813 at which the length of the first extension plate 81 is longest in the orthogonal direction W. In the second extending plate 82, the section 824 at which the length of the second extending plate 82 is shortest in the orthogonal direction W is positioned further in the extending direction J than the section 823 at which the length of the second extending plate 82 is longest in the orthogonal direction W. The first extending plate 81 and the second extending plate 82 of the sewing machine frame 5 contribute to making the tip end portion of the arm frame 8 in the extending direction J lighter.

The longitudinal direction D of the pillar frame 4 is defined as the up-down direction. The arm frame 8 extends in the extending direction J from the upper end of the pillar frame 4. The sewing machine frame 5 includes the bed frame 6 that extends in the extending direction J from the lower end of the pillar frame 4 and faces the arm frame 8. The bed frame 6 includes the first bed plate 61, the second bed plate 62, and the bed intermediate plate 63. The first bed plate 61 extends in the extending direction J. The second bed plate 62 is separated from the first bed plate 61 in the longitudinal direction D, faces the first bed plate 61, and extends in the extending direction J. The bed intermediate plate 63 extends in the longitudinal direction D and the extending direction J, and couples the first bed plate 61 and the second bed plate 62 in the longitudinal direction D. The bed intermediate plate 63 has the curved surfaces 631 and 632 each has the shape in the cross-section perpendicular to the longitudinal direction D that is the curved line. Compared to a case in which the intermediate plate having the curved surfaces is disposed at only one of the bed frame 6 or the arm frame 8, the bed frame 6 and the arm frame 8 of the sewing machine frame 5 contribute to increasing the rigidity of the sewing machine frame 5 without causing an increase in weight.

The longitudinal direction D of the pillar frame 4 is defined as the up-down direction. The pillar frame 4 includes the pillar lower plate 110 that extends in the horizontal direction orthogonal to the up-down direction, at the lower end of the pillar frame 4, and includes the pillar plates 30 and 43. The pillar hole 111 is arranged penetrating the pillar frame 4 in the up-down direction. The pillar hole 111 has a square shape with the sides 113 and 115 that are curved in a bottom view. The pillar plate 43 has the curved surface 433 extending upward from the curved side 113. The pillar plate 30 has the curved surface 303 extending upward from the curved side 115. Compared to a case in which the pillar frame 4 does not include the pillar plates 30 and 43, the pillar frame 4 of the sewing machine frame 5 contributes to increasing the rigidity of the pillar frame 4, without causing an increase in weight. In the pillar frame 4 of the sewing machine frame 5, the pillar plates 30 and 43 can be easily manufactured by removing a shaping mold downward.

The longitudinal direction D of the pillar frame 4 is defined as the up-down direction. The direction orthogonal to each of the longitudinal direction D and the extending direction J is defined as the orthogonal direction W. The length L6 of the lower end of the pillar frame 4 in the orthogonal direction W is longer than the length L5 of the upper end of the pillar frame 4 in the orthogonal direction W. Compared to a case in which the length of the lower end of the pillar frame 4 in the orthogonal direction W is equal to or less than the length of the upper end of the pillar frame 4 in the orthogonal direction W, the pillar frame 4 of the sewing machine frame 5 contributes to increasing the rigidity of the pillar frame 4 without causing an increase in weight.

The direction orthogonal to each of the longitudinal direction D and the extending direction J is defined as the orthogonal direction W. The arm frame 8 includes the arm ribs 86 to 89, and 94 to 100 that protrude in the orthogonal direction W from the extending intermediate plate 83. The pillar frame 4 includes the first pillar ribs 45 and 46 having the thickness Q1 that, in a cross-sectional shape perpendicular to the orthogonal direction W, is greater than the thickness F1 of the arm ribs 86 to 89, 94, and 95 and greater than the thickness F2 of the arm ribs 96 to 100, and includes the first pillar ribs 31, 32, and 39 having the thickness Q2. The pillar frame 4 includes the second pillar ribs 33 to 38 and 47 to 58. The thickness of the second pillar ribs 33 to 38, and 47 to 58 is the thickness smaller than the thickness Q2 of the first pillar ribs 31, 32, and 39, and is smaller than the thickness Q1 of the first pillar ribs 45 and 46. The length in the longitudinal direction D of the second pillar ribs 33 to 38 and 47 to 58 is shorter than the length in the longitudinal direction D of the first pillar ribs 31, 32, 39, 45 and 46. Compared to a case in which the pillar ribs 31 to 39 and 45 to 58, and the arm ribs 86 to 89 and 94 to 100 have the same thickness, the pillar ribs 31 to 39 and 45 to 58, and the arm ribs 86 to 89 and 94 to 100 of the sewing machine frame 5 contribute to securing the rigidity of the pillar frame 4 that is susceptible to a load acting thereon, while narrowing the thickness of the arm ribs 86 to 89 and 94 to 100 and thus achieving weight reduction.

The longitudinal direction D of the pillar frame 4 is defined as the up-down direction and the extending direction J is defined as the left direction. The arm frame 8 includes the coupling curved plate 44 having the arc shape in a front view, below the coupling section 40 with the pillar frame 4. The first pillar ribs 31, 32, 39, 45, and 46 are disposed on tangent lines of the coupling curved plate 44 in a front view. The pillar ribs of the sewing machine frame 5 contribute to securing the rigidity of the coupling section 40 of the pillar frame 4 and the arm frame 8 that are susceptible to a load acting thereon.

The protrusion amount of the first pillar ribs 45 and 46 in the orthogonal direction W is greater than the protrusion amount of the arm ribs 86 to 89, 94, and 95 in the orthogonal direction W. The first pillar ribs 45 and 46 of the sewing machine frame 5 contribute to securing the rigidity of the coupling section 40 of the pillar frame 4 and the arm frame 8 that are susceptible to the load acting thereon.

The direction orthogonal to each of the longitudinal direction D and the extending direction J is defined as the orthogonal direction W. The arm frame 8 includes the arm ribs 86 to 89 and 94 to 100 protruding in the orthogonal direction W from the extending intermediate plate 83. The extending intermediate plate 83 has the holes 90 to 93 that penetrate in the orthogonal direction W arranged along one of the arm ribs 86 to 89 and 94 to 100. The holes 90 to 93 of the sewing machine frame 5 contribute to achieving weight reduction of the arm frame 8, compared to a case in which a plurality of holes are not arranged in the arm frame 8.

The direction orthogonal to each of the longitudinal direction D and the extending direction J is defined as the orthogonal direction W. The extending intermediate plate 83 is coupled to the first extending plate 81 at the section separated from each of both the ends, in the orthogonal direction W, of the first extending plate 81. The extending intermediate plate 83 is coupled to the second extending plate 82 at the section separated from each of both the ends, in the orthogonal direction W, of the second extending plate 82. Compared to a case in which the extending intermediate plate 83 only has flat surfaces, the extending intermediate plate 83 of the sewing machine frame 5 contributes to increasing the rigidity of the arm frame 8 without causing an increase in weight.

The direction orthogonal to each of the longitudinal direction D and the extending direction J is defined as the orthogonal direction W. The length R3 of the range in which the extending intermediate plate 83 extends in the orthogonal direction W is smaller than half the length L1 of the range in which the first extending plate 81 extends in the orthogonal direction W, and is smaller than half the length L3 of the range in which the second extending plate 82 extends in the orthogonal direction W. Compared to the case in which the extending intermediate plate 83 only has the flat surfaces, the extending intermediate plate 83 of the sewing machine frame 5 contributes to increasing the rigidity of the arm frame 8 without causing an increase in weight.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below:

The present disclosure is not limited to the above-described embodiments, and various changes are possible. The sewing machine frame 5 may be a sewing machine frame of any desired type of sewing machine, such as a household sewing machine, an industrial sewing machine, a multi-needle sewing machine, an embroidery sewing machine, and the like. The shape and size of the sewing machine frame 5 may be changed as appropriate in accordance with a type and configuration of the sewing machine 1. For example, in a case where the sewing machine 1 does not include the projector module 20, the sewing machine frame 5 need not necessarily include the projector support plate 85. The definitions of the directions of the sewing machine frame may be changed in accordance with the sewing machine to which the sewing machine frame is mounted.

Only one of the bed frame 6 or the arm frame 8 may include the intermediate plate having the curved surface. The pillar plate 30 need not necessarily have the curved surfaces 303 and 304. The pillar plate 43 need not necessarily have the curved surfaces 433 and 434. Each of the extending intermediate plate 83, the pillar plates 30 and 43, and the bed intermediate plate 63 may have the curved surfaces each having the shape in a cross-section parallel to the longitudinal direction D that is the curved line. The shape of the first contour that is the contour of the end 811 of the first extending plate 81 may be changed as appropriate and may be a straight line in a plan view, for example. The shape of the second contour that is the contour of the end 821 of the second extending plate 82 may be changed as appropriate and may be a straight line in a plan view, for example. The end 811 of the first extending plate 81 may be the rear end of the first extending plate 81. The end 821 of the second extending plate 82 may be the rear end of the second extending plate 82. In the first extending plate 81, the section 813 at which the length of the first extending plate 81 is longest in the orthogonal direction W may be positioned further in the extending direction J than the section 814 at which the length of the first extending plate 81 is shortest in the orthogonal direction W. In the second extending plate 82, the section 823 at which the length of the second extending plate 82 is longest in the orthogonal direction W may be positioned further in the extending direction J than the section 824 at which the length of the second extending plate 82 is shortest in the orthogonal direction W. The pillar hole 111 need not necessarily be arranged in the pillar lower plate 110, and the pillar hole 111 may be a polygonal shape having only straight sides in a bottom view, or may be a shape having a contour configured only by a curved line, such as an ellipse, a circle, or the like. A number and shape of the pillar plates 30 and 43 that extend upward from the sides of the pillar hole 111 may be changed as appropriate. Only one of the pillar plates 30 and 43 may have the curved surfaces. The pillar plate 43 need not necessarily have the curved shape above the hole 422. The pillar plate 30 need not necessarily have the curved shape above the hole 423. More specifically, the extending intermediate plate 83, the pillar plate 43, and the bed intermediate plate 63 may be configured by a single plate having the same or a similar range of spread in the orthogonal direction W. Having a similar range of spread in the orthogonal direction W refers to a case in which, for example, the ranges of spread of the extending intermediate plate 83 and the bed intermediate plate 63 overlap the range of spread of the pillar plate 43 in the orthogonal direction W by 90% or more. The pillar plate 30 may be configured by a flat surface plate perpendicular to the orthogonal direction W. In these cases, the extending intermediate plate 83, the pillar plates 30 and 43, and the bed intermediate plate 63 contribute to increasing the rigidity of the sewing machine frame 5, compared to a case in which the pillar plates 30 and 43 are curved in accordance with the configuration of the sewing machine 1.

The longitudinal direction D of the pillar frame 4 is defined as the up-down direction, and the direction orthogonal to both the longitudinal direction D and the extending direction J is defined as the orthogonal direction W. The length L6 in the orthogonal direction W of the lower end of the pillar frame 4 may be equal to or less than the length L5 in the orthogonal direction W of the upper end of the pillar frame 4.

The shape, number, protrusion amount, and arrangement of the arm ribs 86 to 89 and 94 to 100 may be changed as appropriate. The arm ribs may be arranged only on one surface of the extending intermediate plate 83 in the orthogonal direction W. The shape, number, protrusion amount, and arrangement of the first pillar ribs and the second pillar ribs may be changed as appropriate. The first pillar ribs and the second pillar ribs may be disposed only on one surface of the pillar plates 30 and 43. The first pillar ribs 31, 32, 45, and 46 need not necessarily be disposed on the tangent lines of the coupling curved plate 44. The plurality of holes penetrating in the orthogonal direction W need not necessarily be arranged in each of the pillar plates 30 and 43, the bed intermediate plate 63, and the extending intermediate plate 83. The number, shape, arrangement, and size of the plurality of holes arranged in the pillar plates 30 and 43, the bed intermediate plate 63, and the extending intermediate plate 83 may be changed as appropriate, and need not necessarily be arranged along the ribs, for example.

The extending intermediate plate 83 may be coupled to one end of the first extending plate 81 in the orthogonal direction W. The extending intermediate plate 83 may be coupled to one end of the second extending plate 82 in the orthogonal direction W. The bed intermediate plate 63 may be coupled to one end of the first bed plate 61 in the orthogonal direction W. The bed intermediate plate 63 may be coupled to one end of the second bed plate 62 in the orthogonal direction W. The length of the range in which the extending intermediate plate 83 extends in the orthogonal direction W may be equal to or less than 1.2 times the thickness of the extending intermediate plate 83, may be equal to or greater than half the length of the range in which the first extending plate 81 extends in the orthogonal direction W, and may be equal to or greater than half the length of the range in which the second extending plate 82 extends in the orthogonal direction W.

What is claimed is:

1. A sewing machine frame comprising:

a pillar frame; and an extending frame extending from one end in a longitudinal direction of the pillar frame, in an extending direction orthogonal to the longitudinal direction, wherein the extending frame includes a first extending plate extending in the extending direction, a second extending plate separated from the first extending plate in the longitudinal direction, the second extending plate facing the first extending plate and extending in the extending direction, and an extending intermediate plate extending in the longitudinal direction and the extending direction, the extending intermediate plate coupling the first extending plate and the second extending plate in the longitudinal direction, and the extending intermediate plate having a curved surface the curved surface having a cross-sectional shape as a curved line in a plane perpendicular to the longitudinal direction.

2. The sewing machine frame according to claim 1, wherein the longitudinal direction of the pillar frame is defined as an up-down direction, the extending frame is an arm frame extending in the extending direction from an upper end of the pillar frame, and the sewing machine frame further comprises:

a bed frame extending in the extending direction from a lower end of the pillar frame and facing the extending frame.

3. The sewing machine frame according to claim 1, wherein the longitudinal direction of the pillar frame is defined as an up-down direction, and a direction orthogonal to each of the longitudinal direction and the extending direction is defined as an orthogonal direction, the orthogonal direction includes a first direction and a second direction opposite to the first direction, a first contour, being a contour of an end of the first extending plate in the first direction, is a curved line in a plan view, and a second contour, being a contour of an end of the second extending plate in the first direction, is a curved line in a plan view.

4. The sewing machine frame according to claim 3, wherein in the first extending plate, a section at which a length of the first extending plate in the orthogonal direction is shortest is positioned further in the extending direction than a section at which a length of the first extending plate in the orthogonal direction is longest, and in the second extending plate, a section at which a length of the second extending plate in the orthogonal direction is shortest is positioned further in the extending direction than a section at which a length of the second extending plate in the orthogonal direction is longest.

5. The sewing machine frame according to claim 1, wherein the longitudinal direction of the pillar frame is defined as an up-down direction, the extending frame is an arm frame extending in the extending direction from an upper end of the pillar frame, the sewing machine frame further comprises:

a bed frame extending in the extending direction from a lower end of the pillar frame and facing the extending frame, and the bed frame includes a first bed plate extending in the extending direction, a second bed plate separated from the first bed plate in the longitudinal direction, the second bed plate facing the first bed plate and extending in the extending direction, and a bed intermediate plate extending in the longitudinal direction and the extending direction, the bed intermediate plate coupling the first bed plate and the second bed plate in the longitudinal direction, and a cross-sectional shape of the bed intermediate plate in a plane perpendicular to the longitudinal direction being defined by a curved line.

6. The sewing machine frame according to claim 1, wherein the longitudinal direction of the pillar frame is defined as an up-down direction, the pillar frame includes a pillar lower plate extending in a horizontal direction orthogonal to the up-down direction at a lower end of the pillar frame, the pillar lower plate having a square pillar hole, the square pillar hole penetrating in the up-down direction and having a curved side in a bottom view, and a pillar plate having a curved surface extending upward from the curved side.

7. The sewing machine frame according to claim 1, wherein the longitudinal direction of the pillar frame is defined as an up-down direction and a direction orthogonal to each of the longitudinal direction and the extending direction is defined as an orthogonal direction, a length in the orthogonal direction of a lower end of the pillar frame is longer than a length in the orthogonal direction of an upper end of the pillar frame.

8. The sewing machine frame according to claim 1, wherein a direction orthogonal to each of the longitudinal direction and the extending direction is defined as an orthogonal direction, the extending frame includes an arm rib protruding in the orthogonal direction from the extending intermediate plate, and the pillar frame includes a first pillar rib, a thickness of the first pillar rib being greater than a thickness of the arm rib in a cross-sectional shape perpendicular to the orthogonal direction, and a second pillar rib, a thickness of the second pillar rib being smaller than the thickness of the first pillar rib in the cross-sectional shape, and a length of the second pillar rib in the longitudinal direction being shorter than a length of the first pillar rib in the longitudinal direction.

9. The sewing machine frame according to claim 8, wherein the longitudinal direction of the pillar frame is defined as an up-down direction, and the extending direction is defined as a left direction, the pillar frame includes a coupling curved plate having an arc shape in a front view, below a coupling section with the extending frame, and the first pillar rib is disposed on a tangent line of the coupling curved plate in a front view.

10. The sewing machine frame according to claim 9, wherein a protrusion amount of the first pillar rib in the orthogonal direction is greater than a protrusion amount of the arm rib and greater than a protrusion amount of the second pillar rib.

11. The sewing machine frame according to claim 1, wherein a direction orthogonal to each of the longitudinal direction and the extending direction is defined as an orthogonal direction, the extending frame includes an arm rib protruding in the orthogonal direction from the extending intermediate plate, and the extending intermediate plate has a plurality of holes penetrating in the orthogonal direction along the arm rib.

12. The sewing machine frame according to claim 1, wherein a direction orthogonal to each of the longitudinal direction and the extending direction is defined as an orthogonal direction, the first extending plate and the second extending plate each extend in the orthogonal direction, the extending intermediate plate is coupled to the first extending plate at a section separated from both of ends of the first extending plate in the orthogonal direction, and the extending intermediate plate is coupled to the second extending plate at a section separated from both of ends of the second extending plate in the orthogonal direction.

13. The sewing machine frame according to claim 1, wherein a direction orthogonal to each of the longitudinal direction and the extending direction is defined as an orthogonal direction, a length of a range in which the extending intermediate plate extends in the orthogonal direction is smaller than half a length of a range in which the first extending plate extends in the orthogonal direction, and is smaller than half a length of a range in which the second extending plate extends in the orthogonal direction.

14. A sewing machine frame comprising:

a pillar frame; and an arm frame extending from the pillar frame in an extending direction orthogonal to a longitudinal direction of the pillar frame, wherein the arm frame includes a first extending plate extending in the extending direction, a second extending plate separated from the first extending plate in the longitudinal direction, the second extending plate facing the first extending plate and extending in the extending direction, and an extending intermediate plate extending in the extending direction, the extending intermediate plate coupling the first extending plate and the second extending plate, and the extending intermediate plate having a curved surface, the curved surface having a cross-sectional shape as a curved line in a plane perpendicular to the longitudinal direction.

15. The sewing machine frame according to claim 14, wherein a direction orthogonal to each of the longitudinal direction and the extending direction is defined as an orthogonal direction, a first contour, being a contour of an end of the first extending plate in the orthogonal direction, is a curved line, and a second contour, being a contour of an end of the second extending plate in the orthogonal direction, is a curved line.

16. The sewing machine frame according to claim 14, wherein a direction orthogonal to each of the longitudinal direction and the extending direction is defined as an orthogonal direction, a section at which a length in the orthogonal direction of the first extending plate is longest is positioned, in the extending direction, between the pillar frame and a section at which a length in the orthogonal direction of the first extending plate is shortest, and a section at which a length in the orthogonal direction of the second extending plate is longest is positioned, in the extending direction, between the pillar frame and a section at which a length in the orthogonal direction of the second extending plate in the orthogonal direction is shortest.

17. The sewing machine frame according to claim 14, further comprising:

a bed frame facing the arm frame and extending in the extending direction from the pillar frame, wherein the bed frame includes a first bed plate extending in the extending direction, a second bed plate separated from the first bed plate in the longitudinal direction, the second bed plate facing the first bed plate and extending in the extending direction, and a bed intermediate plate extending in the extending direction, the bed intermediate plate coupling the first bed plate and the second bed plate, and a cross-sectional shape of the bed intermediate plate in a plane perpendicular to the longitudinal direction being defined by a curved line.

18. The sewing machine frame according to claim 14, wherein the pillar frame includes a pillar lower plate including a pillar hole penetrating in the longitudinal direction, the pillar hole having a square shape with a curved side, and a pillar plate having a curved surface extending in the longitudinal direction from the curved side of the pillar hole.

19. The sewing machine frame according to claim 14, wherein a direction orthogonal to each of the longitudinal direction and the extending direction is defined as an orthogonal direction, the first extending plate and the second extending plate each extend in the orthogonal direction, the extending intermediate plate is coupled to the first extending plate between both of ends of the first extending plate in the orthogonal direction, and the extending intermediate plate is coupled to the second extending plate between both of ends of the second extending plate in the orthogonal direction.

* * * * *